United States Patent [19]

Walters

[11] 4,014,520

[45] Mar. 29, 1977

[54] RAILING ASSEMBLY AND METHOD

[76] Inventor: Donald H. Walters, 493 Stanford Drive, Arcadia, Calif. 91006

[22] Filed: Dec. 22, 1975

[21] Appl. No.: 643,363

[52] U.S. Cl. ..... 256/22; 256/59; 256/65

[51] Int. Cl.[2] ..... B21F 27/00; E04H 17/14

[58] Field of Search ..... 256/22, 65, 59, 47

[56] References Cited

UNITED STATES PATENTS

| | | | |
|---|---|---|---|
| 2,771,276 | 11/1956 | Constance et al. | 256/22 |
| 3,522,933 | 8/1970 | Braun | 256/22 |

*Primary Examiner*—Werner H. Schroeder
*Assistant Examiner*—Doris L. Troutman
*Attorney, Agent, or Firm*—William W. Haefliger

[57] ABSTRACT

A balcony or other metal railing assembly which can be readily prefabricated. This assembly includes a top rail and a lower rail, spaced from each other, between which extend vertically a plurality of parallel spaced pickets or spindles. The assembly may be mounted on vertical posts embedded in decking. The top and bottom rails are hollow and configured to receive the ends of the pickets and to snap-lock them in orifices in the top of the bottom rail, and in orifices in a locking cover plate which clips in to recessing in the underside of the top rail. While the bottom rails only extend between mounting posts, since the top rails may be clamped down, and thereby secured, onto the upper ends of the mounting posts, the top rails may extend over the posts without interruption. The bottom rails may also be snap-locked onto specially configured adapters laterally projecting from and secured to the posts. In addition, provision is made for suitable corner attachment of the mitered ends of abutting rails.

Moreover, because of the unique snap-on type construction of this railing system, a method is provided wherein sections of such railing may be prefabricated at an assembly plant and shipped either in condition to be attached to posts, or with the post pre-attached so that all that is necessary to erect the railing is to embed the lower ends of the post into a suitable opening in he decking for cementing or other type of securing.

18 Claims, 22 Drawing Figures

14
14
115
9
9
3
4
16
20
12
10
20
18
18
4
8a
8a
3
10a 32
36
26
22
30
38
26
24a
24
14
34
24
24a
38
46
58
88
83
42
84
84
40
111
110
108
112
112
82
80
102
100
102
20
106
102a
104
90d
90
10

20
80
82
62
60
10
18
88
86
78
64
64
98
96
90c
18
90
92
65
12
94
90a
90b 14
36d
11
22a
10
122
120
22a
114
36e
124
126
120
30
36a
122
118
126
14
112
10
118
11
22
26
10
30
26
36b
22

RAILING ASSEMBLY AND METHOD

BACKGROUND OF THE INVENTION

I. Field Of The Invention

This invention relates to the construction field in general and has particular application to the erection of railings comprising top and bottom rails and spaced pickets extending therebetween. The assembly system, however, could also be used for erecting other types of structures having top and bottom members interconnected by a plurality of spaced elements extending between the two members, such as beams and studding.

II. Description Of The Prior Art

Railings have been provided in building structures for many centuries. Such railings ordinarily comprise a horizontally extending bottom rail and a parallel top rail spaced from the bottom rail, with a plurality of pickets, spindles or other vertical elements extending between the top and bottom rails, spaced from each other, and connected to the top and bottom rails at their respective ends.

In the days when most railings were made of wood, the ends of the pickets were doweled, and such doweled ends were inserted and secured in some manner in orifices provided in the rails. In some instances, the pickets might be secured to the top and bottom rails by means of screws or nails.

After the development of metallurgical techniques to the point where it became practicable to fabricate rails and pickets of metal, pickets have been secured at their ends to rails by a number of different methods, including force fits in orifices, catch locking, and by fastening with screws or bolts. Where the picket ends are force fitted into orifices in the rails, forging, machining or otherwise providing properly mating pickets and orifices can greatly raise the cost of fabricating metal railing systems. The same is also true where the orifices are provided with means to catch lock an appropriate configured end of the picket. Where railing systems are put together with screws or bolting, a considerable amount of labor may be required to produce each rail section. In relatively recent years, railing assemblies have been fabricated of aluminum in order to facilitate the shipping, handling and erection of the rail assemblies at the builing sites. However, heretofore in order to provide the necessary resistance to bending forces which may be exerted by people coming in contact with aluminum railing assemblies, both the rails and the pickets, as well as the posts which support the rail assemblies, have been fabricated of fairly heavy gauge aluminum, particularly where it has been desired to have the rails rectangular in cross section, instead of circular, as with tubing. It has generally been considered more decorative to provide rails and pickets in a rectangular, rather than a tubular, construction. With the constantly rising price of aluminum, the cost of prior art aluminum rails, pickets and posts has continuously escalated to the point where many architects, in an effort to minimize costs of building construction, are being persuaded by their builders to minimize rail assembly use or to adopt less aesthetic tubular type railing systems.

There has existed, therefore, a considerable need for a relatively inexpensive rail assembly system utilizing a minimum of aluminum or other metal which can be put together and erected with a minimum of expensive labor.

SUMMARY OF THE INVENTION

The present invention provides a railing assembly with lightweight horizontal top and bottom rails, pickets and posts, all of which can be rectangular in cross section; and, although strong and rigid, utilize a minimum of metal, such as aluminum, and may be readily fabricated by extrusion and other dies. Moreover, the entire assembly may be prefabricated simply and quickly with a minimum of labor and shipped to the building site for quick and inexpensive erection.

In the assembly of the present invention, the pickets are preferably rectangular in cross section and are notched on opposite sides near their respective ends. The lower notched end of each picket is inserted in an orifice conforming to the cross section of the picket in the top side of the bottom rail. The latter comprises an inverted U-shaped channel member having a pair of longitudinal projections extending inwardly from each side of the channel member and spaced from each other. Both lowermost projections serve to seat the end of the picket, while the upper projections slip into the notches on the sides of the picket to lock the same from withdrawal from the bottom rail. A bottom closure plate may be employed, if desired, in which case the lower projection on each side of the U-shaped channel member may also be configured to provide a receiving slot for the edges of the U-shaped bottom closure plate. When so employed, the bottom closure provides a positive lock assuring that the picket cannot be withdrawn or rattle.

The upper end of each picket is inserted through an orifice, also configured to the cross section of the picket, in a bottom locking closure plate for the top rail. The latter is also formed as an inverted U-shaped channel member, having inwardly extending longitudinal edge flanges and an intermediate transverse web formed integrally with the sides of the inverted U-shaped channel and spaced from both the inwardly extending edge flanges and the top of the channel. A pair of longitudinally extending reinforcing guide elements spaced from each other are disposed in alignment with the edges of the inwardly turned flanges of the channel member and project from the web toward said flanges. The open bottom of the inverted U-shaped channel constituting the top rail is closed by a longitudinally extending closure and locking plate, which is orificed at spaced intervals to receive the upper ends of the pickets. This closure and locking element is of U-shaped cross section with longitudinal slotting provided adjacent both edges where the sides are joined to the transverse connecting portion of the U-shaped plate. A flange extends inwardly from each sidewall of the plate and terminates in an angular longitudinally extending receiving element having a locking catch projection. The latter is designed to slip into the slotting on the side of the upper end of the pickets, and serves to prevent withdrawal of the picket or its rattling after assembly.

An important feature and advantage of this system from an assembly standpoint is that a section of the railing comprising bottom and top rails and a series of pickets may be simultaneously assembled by interfitting them and snapping them together, and this is done without the necessity of utilizing any fasteners in the manner required in prior art devices for railing systems.

In addition, the bottom and top rails without modification may also be snapped onto posts by means of locking inserts fitting both within the top rail and the upper end of the post, in the case of the top rail, and on to laterally extending adapter devices attached to the sides of the post and utilizing the internal configuration of the lower rail for snap locking therein.

By employing further special adapters which are fastened into the top of the corner post and mitering the top rail assemblies, an excellent corner junction of the top rails may be provided.

Because the top rail assembly is essentially hollow, a considerable saving in metal required for the top rail is effected without, however, sacrificing structural rigidity. Such rigidity is assured by the presence of the web integrally formed with the sidewalls of the upper portion of the top rail. Savings in the metal required for the bottom rail, the pickets and the mounting posts are also considerable due to their essential hollow constructions. However, rigidity and strength are not sacrificed. Thus, although the post is extruded as square in cross section, when capped by the top rail and the insert to mount the top rail after the post has been embedded in the decking, it will be found that the post provides solid support for the remainder of the railing assembly. The pickets are similarly extruded, preferably in a square cross section, and when snapped into the top and bottom rails, they will be found to present a firm and rugged barrier. With respect to the bottom railing, it will be found to assume a solid and rigid condition after a series of lower picket ends have been inserted and snap-locked into the orifices in the top wall of the bottom railing. Further strength and rigidity may be imparted to the bottom railing by the use of the bottom cover plate in those installations where such a cover plate may be desired.

It may be seen, therefore, that the present invention offers many advantages over prior art devices, such as considerable savings in the costs of material, fabrication, labor in assembly, and labor in erection of the railing system and in shipping and handling of the prefabricated assemblies. In addition, after installation the railing system will be found to be sufficiently rigid and solid to meet all reasonable building code requirements.

BRIEF DESCRIPTION OF THE DRAWINGS

In the accompanying drawings.

in FIG. 1;

DESCRIPTION OF THE PREFERRED EMBODIMENT

Figure 1:
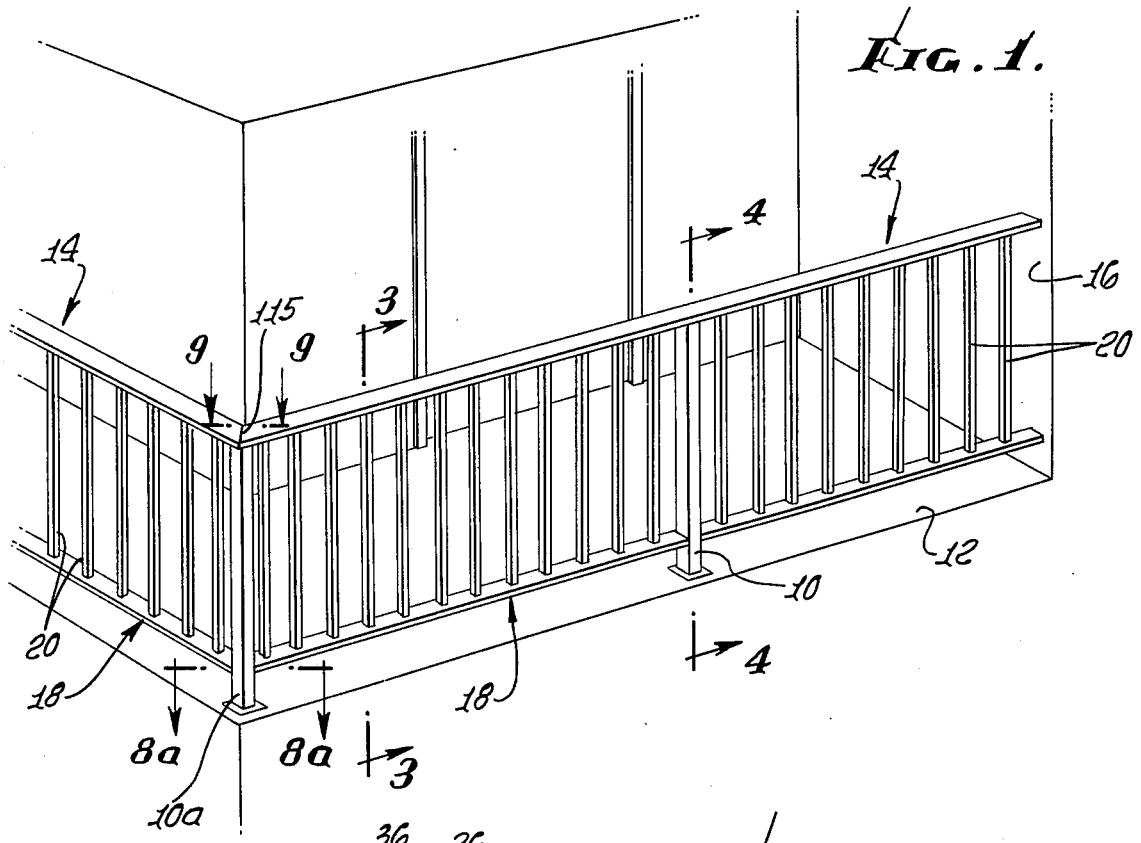
FIG. 1 is a perspective view of a balcony railing employing railing assemblies in accordance with the present invention.

As may be seen from FIG. 1 of the accompanying drawings, a railing assembly fabricated and erected with the present invention may comprise a series of vertical mounting post 10 embedded in a concrete or other form of decking 12 and suitably spaced from each other by a preselected distance, such as, for example, 10 feet. An integral top rail assembly 14 may extend from the corner post 10*a* to a wall 16 without interruption. The bottom rail assemblies 18, however, only extend between each successive pair of posts 10*a* and 10, or between a post 10 and the wall 16. The bottom rail assemblies 18, as may be seen, are spaced from the top rail assemblies 14 and are disposed parallel thereto. A series of pickets or spindles 20 are disposed to extend between the top rail assembly 14 and a bottom rail assembly 18 in the manner of a conventionally appearing railing, and are firmly secured to both said rail assembly and bottom rail. As may also be seen from FIG. 1, two railing assemblies may be brought together and secured on a corner post 10*a*, although as it will appear, a corner juncture is not necessary to the practice of the present invention. Moreover, it would not even be necessary to employ any post 10 where, for example, a realtively short section of a railing assembly might be provided to extend between a wall 16 and an oppositely facing wall (not shown) along the edge of a small balcony defined by such walls.

In order that the present invention may be best understood, the details of the various components of the entire railing assembly will be described under separate headings and, following such descriptions, the method of assembly and erection of the complete railing system will then be presented with reference to the thus described components and their details.

THE TOP RAIL ASSEMBLY

Figure 2:
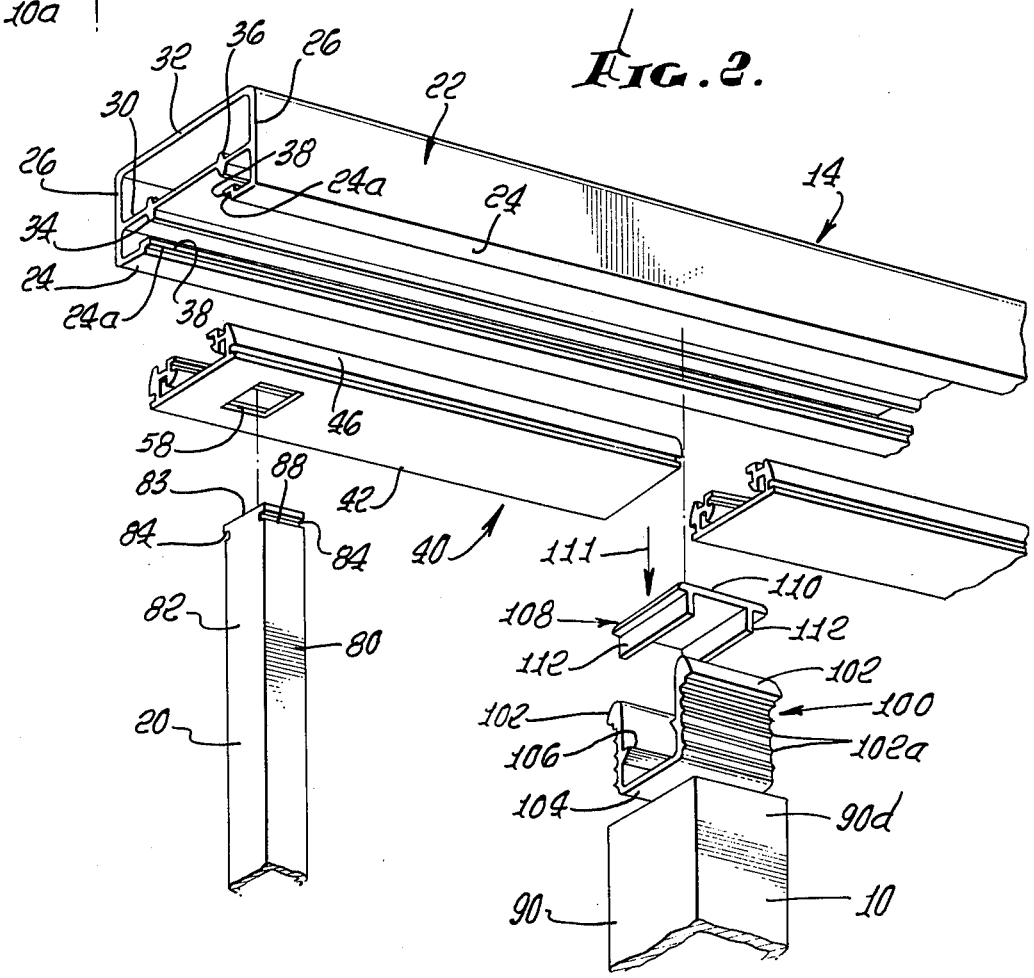
FIG. 2 is a partial perspective and exploded view looking up from below a portion of the railing adjacent one of its mounting posts.
Figure 4:
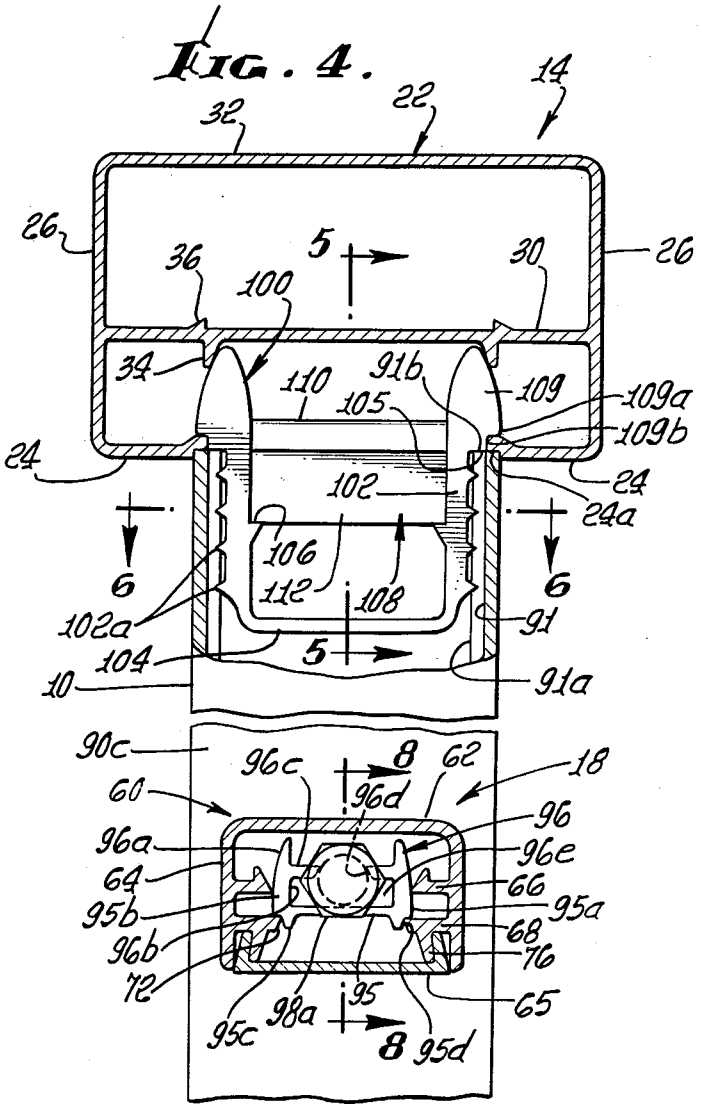
FIG. 4 is a section, partially broken, taken through a post on the line and in the direction of the arrows 4—4 in FIG. 1.
Figure 3:
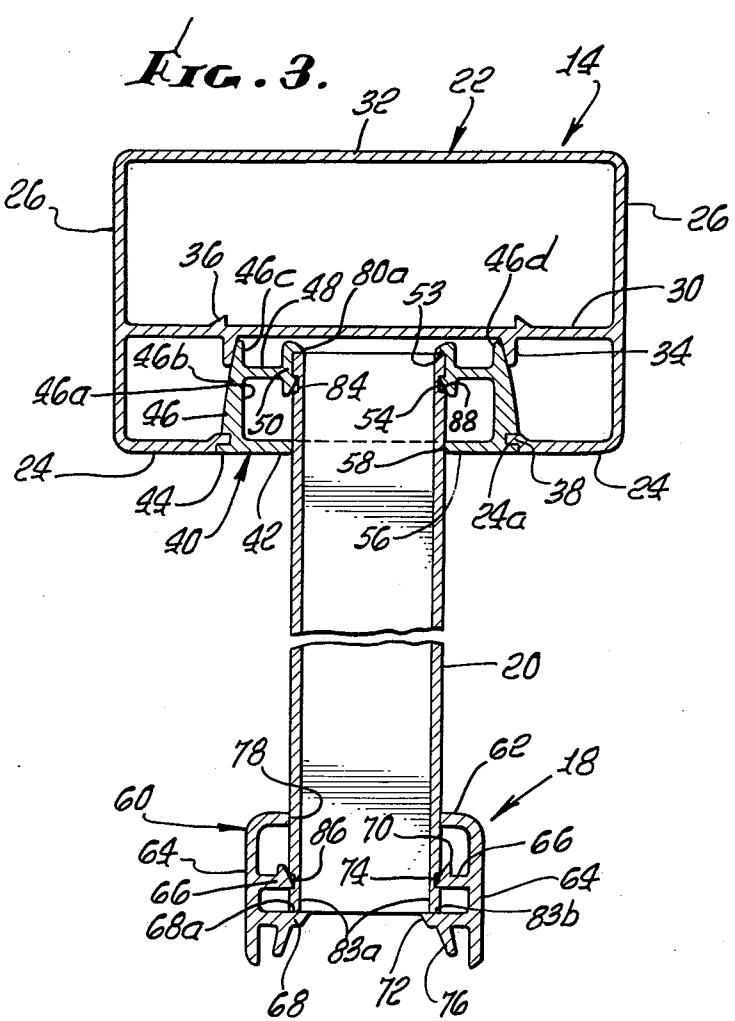
FIG. 3 is a section, partially broken, taken on the line and in the direction of the arrows 3—3 in FIG. 1.

The details of this assembly are best shown in FIGS. 2, 3 and 4. The basic element of this assembly is the longitudinally extending inverted U-shaped channel member 22, the portions 24 of the sidewalls 26, of which are bent toward each other to fit within the configuration in cross section of a rectangle. This channel member 22 is preferably extruded of aluminum stock of a thickness of 55 thousandths of an inch. Integrally formed with the sidewalls 26 is a transverse web 30 which is parallel to the top wall 32 of the channel 22 and is spaced thereform as well as from the bent over sidewall portions 24. By providing the web 30 to extend between the sidewalls 26, the channel member 22 assumes a rigid condition and neither of the sidewalls 26 may be forced apart or together from their parallel condition in the rectangular cross section comprising the top wall 32, sidewalls 26 and web 30, of the channel member 22. In the extrusion of the channel member 22 with the web 30, provision is also made for one pair of rails 34 to extend longitudinally with the web and to project downwardly for at least a short distance towards the bent over sidewall portion 24 of the channel member 22, and another pair of rails 36 to extend upwardly from the opposite side of the web 30. These rails 34, 36 are spaced from each other by approximately the distance between the edges 24*a* of the bent over sidewall portion 24 of the channel 22. The edges 24*a* are actually stepped in the manner shown thereby to provide outwardly of each of the edges 24*a* right-angled groove 38.

The other portion of the top rail assembly 14 comprises a cover locking plate 40 which, however, extends longitudinally only the distance between adjacent mounting posts 10, 10*a*, or between a mounting post and a wall 16 at which the channel member 22 also terminates. The cover locking plate 40 as may be best seen in FIG. 3 is essentially U-shaped in cross section, having a bottom wall 42 from each of the edges 44 of which extends upwardly a sidewall 46. The oppositely facing inner sides 46*a* of the sidewalls 46 may be parallel to each other, but their outersides 46*b*, after starting from their edges 44 and being stepped to form rectangularly shaped channels 46*c*, are slightly arcuate. In addition, integrally formed with each of the sidewalls 46 and extending inwardly toward the opposing sidewall 46, is a flange member 48 parallel to the bottom wall 42. Flange member 48 terminates in a transverse channel member 50, having an inner overhang 53 portion and a projection 54 preceded by a ramp 56.

The bottom wall 42 is provided with a series of openings 58 of the size and shape conforming to the cross section of the spindles or pickets 20. One opening 58 is provided for each such picket or spindle 20.

THE BOTTOM RAIL ASSEMBLY

Figure 7:
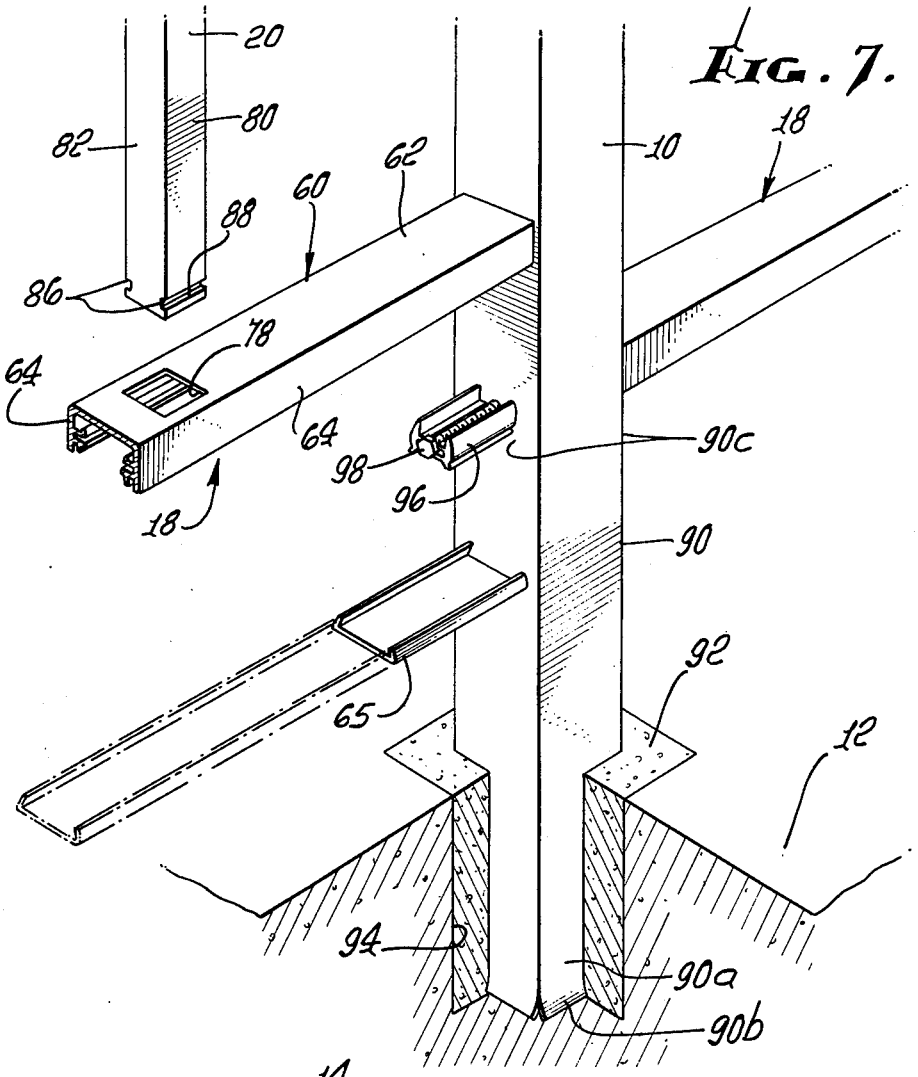
FIG. 7 is a partial perspective and exploded view looking down toward the bottom rail and bottom of the post shown in FIG. 2.
Figure 9:
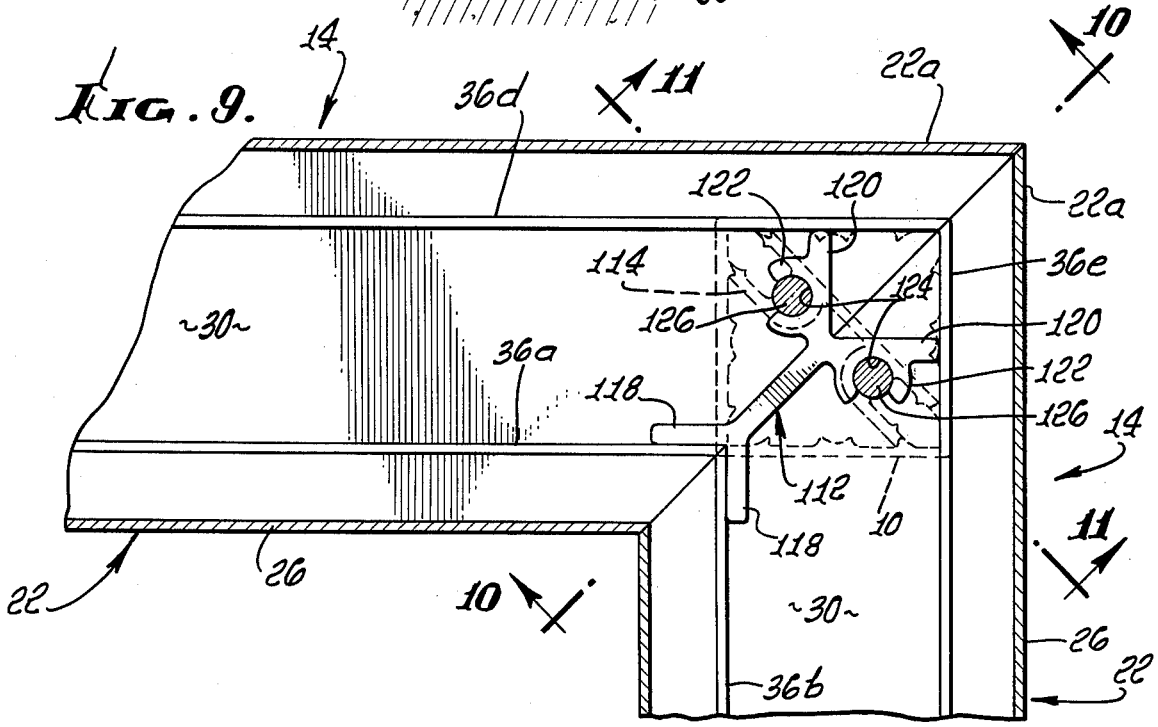
FIG. 9 is an enlarged plan view of the corner junction looking in the direction of the arrows 9—9 in FIG. 1.
Figure 10:
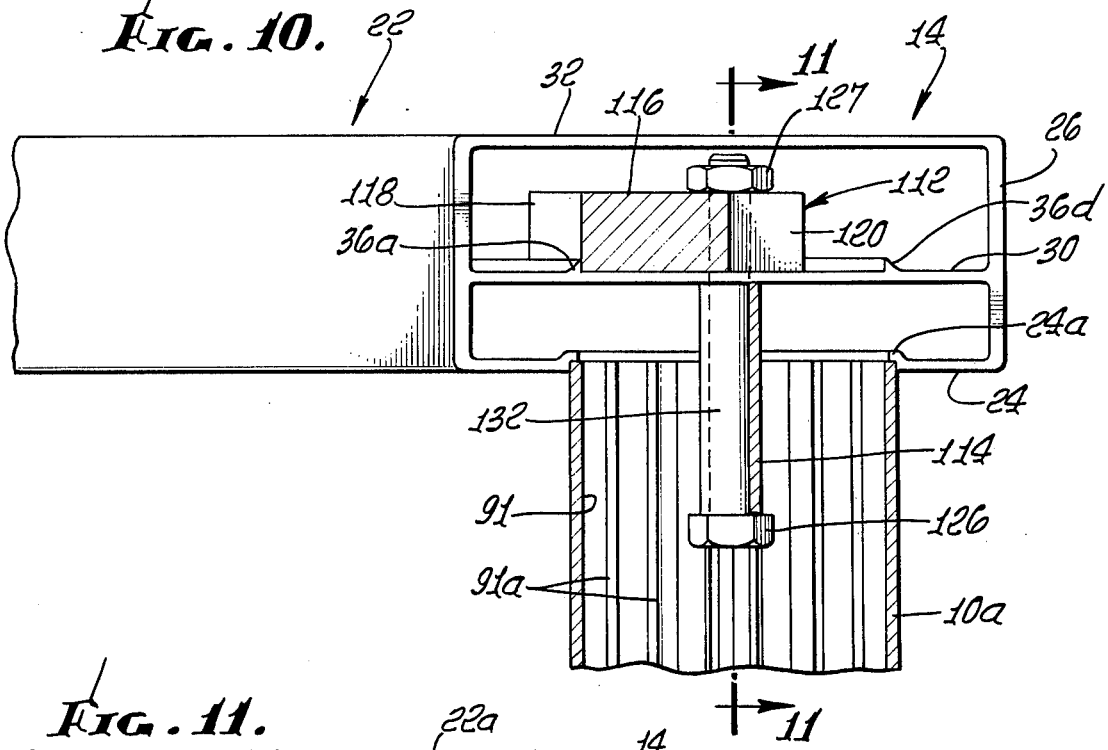
FIG. 10 is a section taken on the line and in the direction of the arrows 10—10 in FIG. 9.
Figure 11:
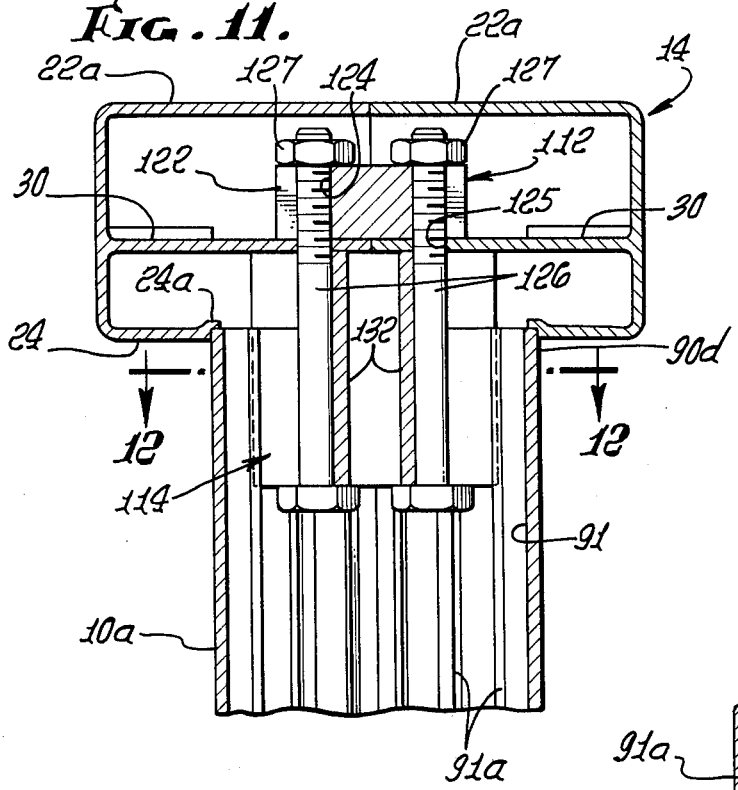
FIG. 11 is another section taken on the line and in the direction of the arrows 11—11 in FIG. 9.

The details of this assembly are shown in FIGS. 4 and 7 of the drawings. An inverted U-shaped channel member 60 comprises a top wall 62 from the edges of which project downwardly at right angles a pair of sidewalls 64. This channel member 60 may also be extruded from aluminum and in the extrusion process inwardly projecting longitudinally extending flanges 66 and 68 may be provided integral with each sidewall 64. The innermost flange 66 may be configured in the manner shown in FIG. 4 with an angular edge 70. The flange 68 may be also specially configured to provide an angular edge 72 preceded outwardly by a ramp 74. Flange 68 may also be desirably provided further with a downwardly and outwardly angled locking flange 76.

The bottom rail assemblies 18, just as the top rail cover locking plates 40, extend only between adjacent posts 10, 10*a* or between a post 10 and an adjacent wall 16. Similarly, each U-shaped channel member 60 is provided with a series of orifices or openings 78 similar in size and configuration to the openings 58 in the bottom wall 42 of the bottom cover locking plate 40 for the top rail 22, for the purpose of enabling the pickets to be passed through the wall 62 in a manner later to be described. Although it is not necessary for a complete bottom rail assembly, a further U-shaped cover plate 65 may be provided for insertion into the locking flanges 76 shown in FIG. 4, and is desirable for the purposes of better securing the pickets 20 within the channel member 60 and to prevent their rattling, and also to enable the ends of the latter to grip the adapters 96 extending from posts 10 in the manner hereinafter described.

THE PICKETS FOR SPINDLES

Picket details are shown in FIGS. 2, 3 and 7. Each picket or spindle 20 may also be extruded of aluminum and may be rectangular in cross section so as to have two pairs of oppositely facing sidewalls 80, 82. The pair of sidewalls 80 which extend parallel to the bottom and top rail assemblies 14 and 18, respectively, are notched at 84 at the top of each picket, and at 86, at the bottom of each picket. These notches, 84, 86 are preferably rectangular although they could be of other configurations and still accomplish the objectives of the parent invention so long as each notch present, on its side nearest the picket end, a transverse shelf or ledge 88, the function of which will later be explained. The length of each picket or spindle 20 should be such that the picket extends through the bottom wall 42 of the top rail assembly closure plate 40 and almost to the transverse web 30 in the channel member 22 on the one hand, and through the opening 78 in the top wall 62 of the bottom channel member 60 to the lower flange 68, as best shown in FIG. 3 of the drawings.

The Mounting Post Assembly

The details of the mount post assembly are best shown in FIGS. 2, 4, 5, 6, 7 and 8. Each mounting post assembly 10 comprises a hollow aluminum element 90 which is preferably square in cross section with a wall thickness of the order of 0.070 foot and of a length which extends from the edge 24*a* of the channel member 22 down into the decking a sufficient distance to enable the post assembly 10 to be securely supported in said decking against any movement as shown in FIG. 7. The lower end 90*a* of the element 90 may be flared outwardly as at 90*b* in order to prevent the element 90 from being pulled out of cementing 92 which may be poured into the hole 94 in the decking 12 after the element 90 has been properly set and positioned in the hole 94. The insides of the four walls 91 may be extended with inwardly projecting angular ridges 91*a*, the functions of which will be later explained.

At a predetermined level above the decking 12, at which level it is determined that the lower rail is to be supportingly mounted, adapters 96 are secured by screws 98 to project laterally from opposing sides 90*c* of the element 90. Each of these adapters 96 comprises a bottom wall 95 from each of the side edges 95*a* of which projects upwardly at a right angle to the wall 95 a sidewall 95*b* having an arucate or convex outside 96*a* and a planar inside 96*b*. Projecting inwardly toward the opposite wall sidewall 95*b* from the inside 96*b* of each wall 95*b* is a further flange 96*c* having angular edges 96*d*. With this arrangement of walls and flanges, it may be seen that a mounting screw 98 may be passed through the open space 96*e* defined by the bottom wall 95, the sidewalls 95*b* and the flanges 96*c*, with the head 98*a* of the screw 98 pressing against the outermost edges such space defining elements.

In addition, there are provided below the outsides of the side edges 95*a* of the wall 95, a pair of small outwardly projecting flanges 95*c*, each of which defines with lowermost edge of the arcuate outer wall 96*a*, a groove 95*d*.

A U-shaped rail mounting and locking cap 100 is provided with sidewalls 102 having a length slightly less than the distance between the insides of opposing walls of the element 90. The walls 102 are preferably stepped on their outer sides to provide a series of linearly extending serrations 102*a*. The walls 102 are both somewhat resilient with respect to their positioning relative to the transverse bottom wall 104, and the latter is of such dimension that the cap 100 may be slipped down into the upper end 90*d* of the element 90 to the point where an undercut 105 on the outside of the upper expanded edges 109 of the sidewalls 102 comes to rest upon the upper edges 91*b* of the angular ridges 91*a* inside the post element 90. The inside of each wall 102 of the cap 100 may be provided with a ledge 106 which projects toward a corresponding ledge 106 in the oppositely facing wall 102.

The other element of the post assembly is a double T-shaped wedge 108. This wedge 108 comprises a rigid top wall 110 formed integrally with a pair of downwardly projecting rails 112. This wedge desirably should be of a harder metal than that from which the resilient U-shaped cap 100 is formed, and further should be so rigid that it will not yield when it is forced downwardly between the walls 102 of the cap 100. In this connection, the configuration and dimensions of the wedge 108 should be such that the two rails 112 and the top plate 110 may be inserted into and force fitted between the walls 102 after the cap 100 shall have been inserted into the end 90*d* of the element 90, thereby to secure the cap within said element end 90*d*.

CORNER POST ACCESSORIES

In order to accomplish a corner junction such as is illustrated on the left side of FIG. 1, in accordance with the present invention, the top channel elements 22 are mitered at 45° angles so that they may be brought together at a right angle. It will be appreciated, however, that no such mitering is required for either the bottom cover locking plate 40 or the bottom rail assembly 18, since both this plate 40 and the rail assembly 18 will terminate in abutment with a sidewall 91 of the corner post 10*a*.

In order to secure together the two mitered ends of the channel elements 22, which are brought together to form the corner, two securing elements, 112 and 114, may be provided. Element 112, which is intended to be placed on top of the webs 30 of the mitered ends of the channel elements 22, comprises a short linearly extending vertical section 116 which is bifurcated at both of its ends at right angles to provide, at one end, a pair of wings 118 and, at the opposite end, another pair of wings 120. The wings 118 extend for a short distance and are intended to co-align at a right angle the abutting ends of the two rails 36*a* and 36*b*, which extend upwardly from the webs 30. The wings 120 each extend at right angles to each other far enough outwardly to abut the rails 36*d* and 36*e*, which also extend upwardly from the webs 30. In addition, each wing 120 includes an arcuate portion 122 which defines at least two-thirds of a threaded opening 124 into which may be screwed the shank of a matingly threaded bolt 126. Thus, when the bolt 126 is tightened each arcuate portion 122 may be drawn against a web 30.

Figure 12:
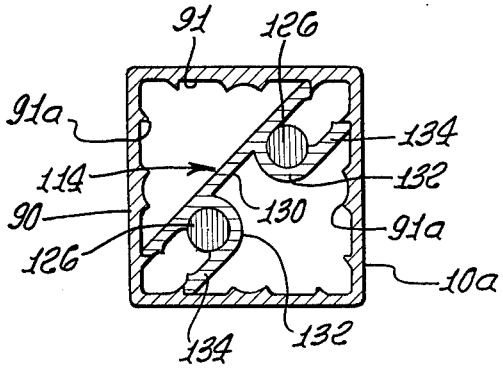
FIG. 12 is a section taken on the line and in the direction of the arrows 12—12 in FIG. 11.
Figure 13:
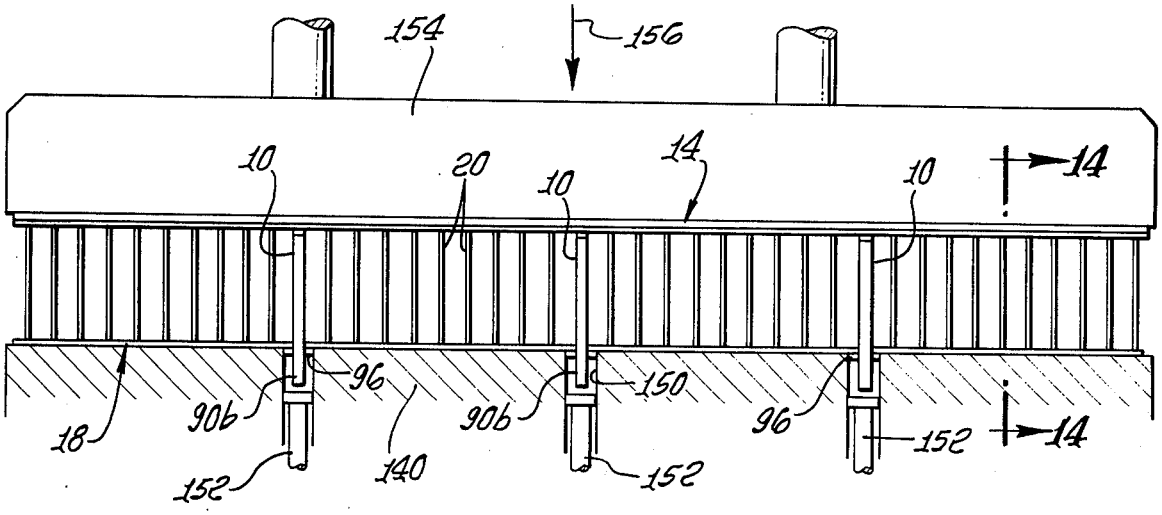
FIG. 13 is a plan view, party schematic, illustrating the manner in which the railing assembly components are laid out in preparation for assembly.

The element 114 is comprised of a vertical wall 130 from one side of which extend a pair of arcuate walls 132, each of which terminates in an extension 134 parallel to the wall 130. The height of the wall 130 and its extensions 132, 134 is such that, when the upper surface of the element 114 is placed in abutment with the web 30, the wall 130 and extensions 132, 134 will extend down between the opposed edges 24*a* of the top rail channel member 22 a sufficient distance to be inserted into the top 90*d* of a corner post 10*a* and thereby secure the corner junction of the two mitered top rail elements 22 by force fit into the corner post 10*a*. In that connection the spacing of the wall extensions 134 from the wall 130 and the overall lengths of the wall 130 and the oppositely directed walls 132, 134 are such that, when the element 114 is inserted diagonally in the top 96*d* of the corner post 10*a*, the element 114 will completely span the diagonal distance between the insides of the walls 91 of the post element 90, and particularly will seat in against the angular ridges 91*a* in the manner illustrated in FIG. 12. As may also be seen in the drawings, the space defined between the wall 130 and the arcuate extensions 132 serves to enable the bolts 126 to be passed therethrough and tightened to hold the element 114 against the undersurface of the web 30.

INTERFITTING OF ASSEMBLY COMPONENTS

In describing the manner of interfitting of the pickets 20 with the top and bottom rail assemblies 14 and 18, there should first be explained the manner of securing of the upper ends 83 of each picket to the top rail assembly 14: The upper notched end 83 of each picket 20 is passed through an opening 58 in the bottom wall 42 of the locking cover plate 40 for the top rail assembly 14, to the point where the upper edges 80*a* of the picket walls 80 ride over the ramps 56, pass the projections 54, and seat against the ledges 53 defined by the overhung portion 42 of the transverse channels 50. When the upper edges 80*a* of the picket walls 80 are thus seated against the ledges 53, the projections 54 will be found to have slipped into the grooves 84 in the picket walls 80, thereupon locking the pickets into the locking cover plate 46 in an orientation normal to the transverse bottom wall 42 of the plate 40. After pickets 20 have thus been inserted through each of the openings 58 in, and locked into, the full length of a locking cover plate 40, the arcuate sidewalls 46*b* of such plate 40 are then forced between the oppositely facing edges 24*a* of the bent over portions 24 of the sidewalls 26 of the top rail channel element 22 to where the leading edges 46*d* of the sidewalls 46 seat between and tightly abut the opposing sides of the rails 34 projecting downwardly from the web 30. As such leading edges 46*d* reach their limits of penetration by contacting the outside of the web 30, the two opposed resilient walls 46 will be forced inwardly toward each other, more tightly to secure the projections 54 in the grooves 84 in the picket walls 80, while simultaneously the inner edges 24*a* of the channel member 22 will snap into the rectaungularly shaped channels 46*c*, thereby securing the bottom locking cover plate between those two edges and presenting a flushly appearing bottom wall for the top rail assembly 14.

The bottom end 83*a* of each picket 20 is similarly passed through an opening 78 in the top wall 62 of the bottom rail channel member 60 to where it seats upon the inwardly projecting ledges 68*a* formed by the upper sides of the flanges 68. When the bottom side edges 83*b* of the pickets 20 seat upon these ledges 68*a*, it will be found that the angular edges 70 of the innermost flanges 66 of the bottom rail channel member 60 will snap into the grooves 86 in the lower end 83*a* of the pickets 20, thereby locking the picket against withdrawal from the channel member 60. Where a bottom cover plate 65 is employed, it may serve to prevent the walls 64 of the bottom rail channel member 60 from being forced apart to where the pickets may be withdrawn from the openings 78 in the top wall 62 of the channel member 60. It also provides a more finished appearance to the bottom rail assembly 18.

From the standpoint of assembly one may find that it is better first to insert the bottom ends 83*a* of the pickets 20 into the bottom rail assembly 18 before putting the top ends 83 of the pickets 20 in the locking cover plate 40 of the top rail assembly 14. By assembling a railing section comprised of a bottom rail assembly 18, a series of pickets 20 and the locking cover plate 40 for the top rail assembly 14 in the order described in the preceding sentence, it will be found that greater stability is provided for such assembly as the locking cover plate with the inserted pickets is being forced between the edges 24*a* of the top rail channel member 22 for securing within the latter.

Figure 5:
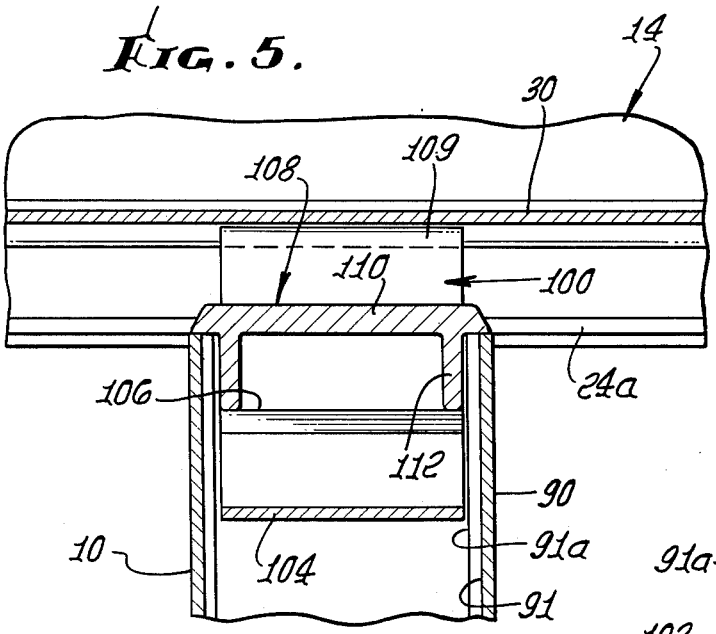
FIG. 5 is a section taken on the line 5—5 and in the direction of the arrows 5—5 in FIG. 4.
Figure 6:
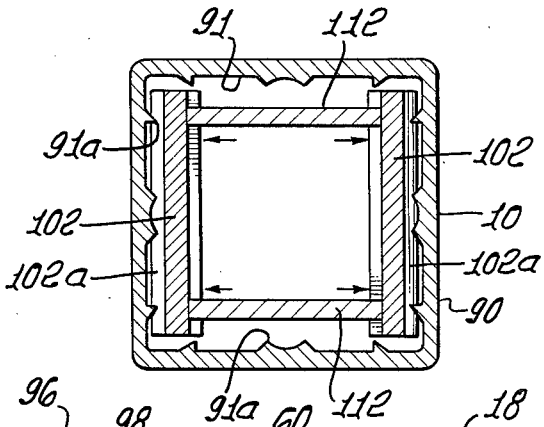
FIG. 6 is a section taken on the line and in the direction of the arrows 6—6 in FIG. 4.

Turning next to the manner of mounting a railing assembly comprising top and bottom rails 14, 15 and a series of pickets 20, upon an intermediate post 10, as shown in FIG. 1, a U-shaped capping member 100 is placed in and, to the extent required, hand forced into the top end 90*d* of the post element 90 to where the undercuts 105 seat upon the upper edges 91*b* of the angular ridges 91*a* inside the post element 90. This should not be difficult since the sidewalls 102 of the element 100 will move somewhat resiliently toward each other. The wedge 108 is then forced downwardly in the direction of the arrow 111 (FIG. 2) until it strikes the ledges 106 and a secure and tight fit, such as is shown in FIGS. 4 and 5, is obtained. When this occurs the two walls 102 are driven apart from each other to where their stepped serrations 102*a* imbed themselves in the angular ridges 91*a* on the inside wall of the element 90.

It may be seen that the outer sides of the upper extremities 109 of the sidewalls 102 are slightly arcuate and extend outwardly to a maximum point 109*a* whereupon the wall becomes undercut at 109*b*. It will be readily appreciated that with this construction, after the edges 24*a* of the channel member 22 are first forced apart to permit the arcuate walls 109 to be passed between such edges 24*a*, the edges 24*a* will snap back as the points 109*a* are passed, to seat those edges in the recesses defined by the overhangs defining the undercut 109*b*. Simultaneously, stability will be provided by seating of the leading edges of the upper portions of the walls 109 between the rails 34 projecting downwardly from the web 30 of the top rail channel member 22.

The bottom rail 18 is mounted upon the post 10 by pressing the channel member 60 downwardly upon the arcuate sidewalls 96*a* of the adapter 96. When this is done, the angular edges 72 of the flanges 68 extending inwardly towards each other from the respective sidewalls 64 of the channel member 60, first ride up over the arcuate sidewalls 96*a*, thereby forcing the sidewalls 64 and flanges 68 apart. With further downward pressure being applied to the channel member 60, the angular edges 72 pass over the arcuate sidewalls 96*a* and seat in the grooves 95*d* to lock the channel member 60 on the adapter 96.

Where two railing sections are to be brought together and assembled in a right angled corner in the manner shown on the left side of FIG. 1, the bottom rail assembly 18 for each section is cut to abut normally a side of the post 10*a*. Similarly, the bottom locking cover plate 40 for each of the two top channel members 22 which are to be brought together and secured in a right angle corner, is also cut so that such bottom cover locking plate 40 will abut normally one side of the post 10*a*. However, the ends 22*a* of the two channel members 22 which are to be brought together to form the corner are mitered at 45° angles. Thereby, when the two channel member ends 22*a* are brought together, it will be at a right angle as shown at 115 in FIG. 1.

After the upper ends 83 of the pickets 20 for each railing section to be brought together at a corner have been inserted through the openings 58 in the bottom walls 42 of the bottom locking cover plates 40 and the latter have been snapped into the channel members 22, and before a post 10*a* is brought into the assembly, a hole 125 is first drilled or otherwise provided in the web 30 at the mitered channel element end 22*a* in such location as to enable a bolt 126 to be passed therethrough. After such hole 125 has been provided in each web 30, the elements 114 are positioned on the lower sides of the web 30 and bolts 126 are inserted upwardly through elements 114 and the holes 125. Nuts 127 are then loosely threaded onto the upwardly projecting ends of the bolts 126 so that the opening 124 in the wings 120 of the element 112 may be brought around the shanks of the bolts 126. When the two mitered ends 22*a* have been thus brought together and the elements 112 and 114 properly positioned, the bolts 126 are tightened by a wrench to the point where the two mitered ends 22*a* become firmly secured together.

Figure 8:
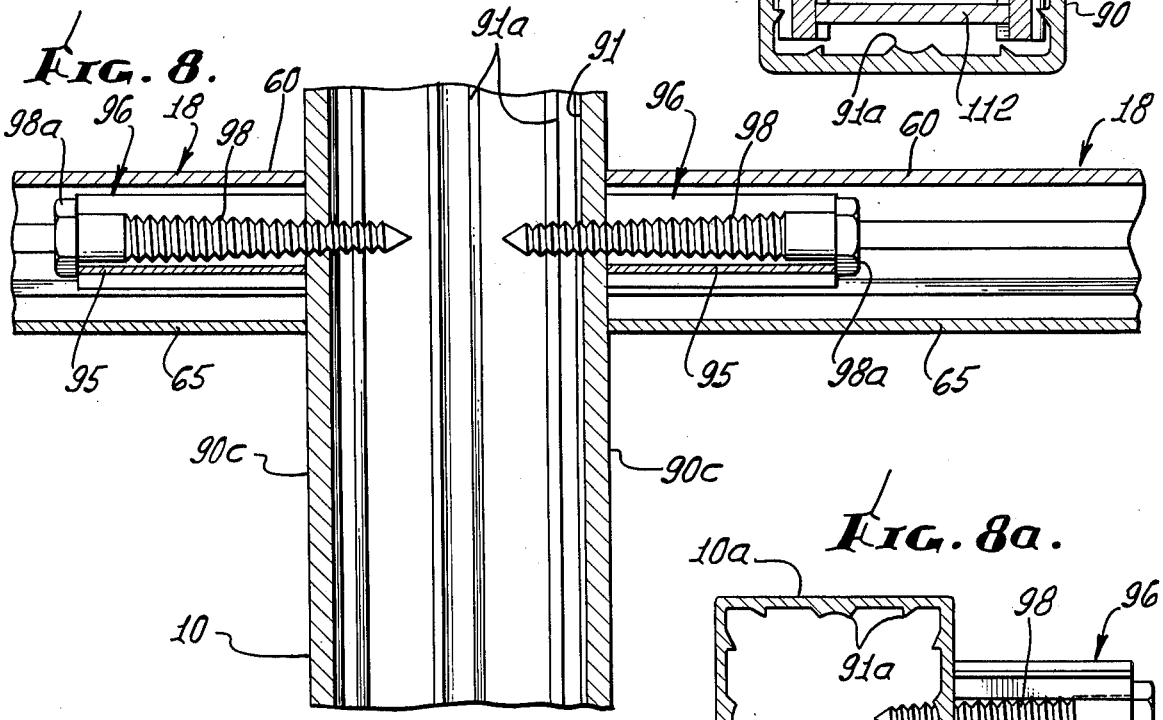
FIG. 8 is a section taken on the line and in the direction of the arrows 8—8 in FIG. 4.
Figure 8A:
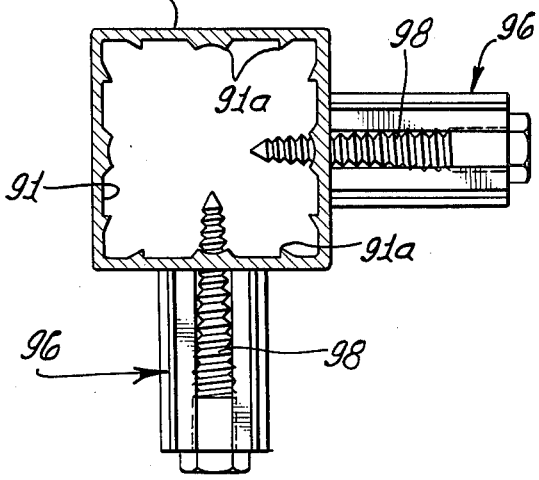
FIG. 8*a* is a section on the line and looking in the direction of the arrows 8*a*—8*a*1.

The corner post 10*a* is then brought into position and pushed together with the downwardly projecting element 114 and the joined mitered ends 22*a* of the channels 22. Simultaneously the ends of the bottom channel elements 60 will be forced over the adapters 96 projecting from the post 10*a* in the manner shown in FIG. 8*a*. As the upper end of the post 10*a* is pushed over the protruding side edges of the vertical wall 130 and the extensions 134 of the arcuate walls 132 of the element 114, it will be found that such edges will either dig slightly into the insides of the post walls or will become wedged in against one of the angular ridges 91*a* in the manner illustrated in FIG. 12. Between such a forced fit and the catch locking of the bottom rail channel members 60 on the adapters 96, it will be found that when the post is secured in the decking 12, the rail assemblies which have been mounted on the post 10*a* cannot be removed from the post without such an amount of force as will demolish at least a portion of the railing assembly.

APPARATUS AND METHOD FOR ASSEMBLING RAIL SYSTEMS

It is also a feature of the present invention to provide means and apparatus for assembling on a production basis a railing system of the type illustrated in the drawings and hereinabove described. One method and apparatus for accomplishing such assembly is illustrated in FIGS. 13 through 16 of the drawings. According to this method and apparatus, a special assembly table or deck 140 is provided with a centrally raised section 142 upon which the pickets 20 are first laid out side by side preparatory to assembly with the top and bottom railing systems 14, 18 and the posts 10. Desirably, this raised section 142 of the table 140 would be provided with marking lines to enable a workman properly to lay out the pickets 20 for the assembly operations. The table or deck 140 should also have lower level sections 144, 146 on each side of the central section 142.

Figure 14:
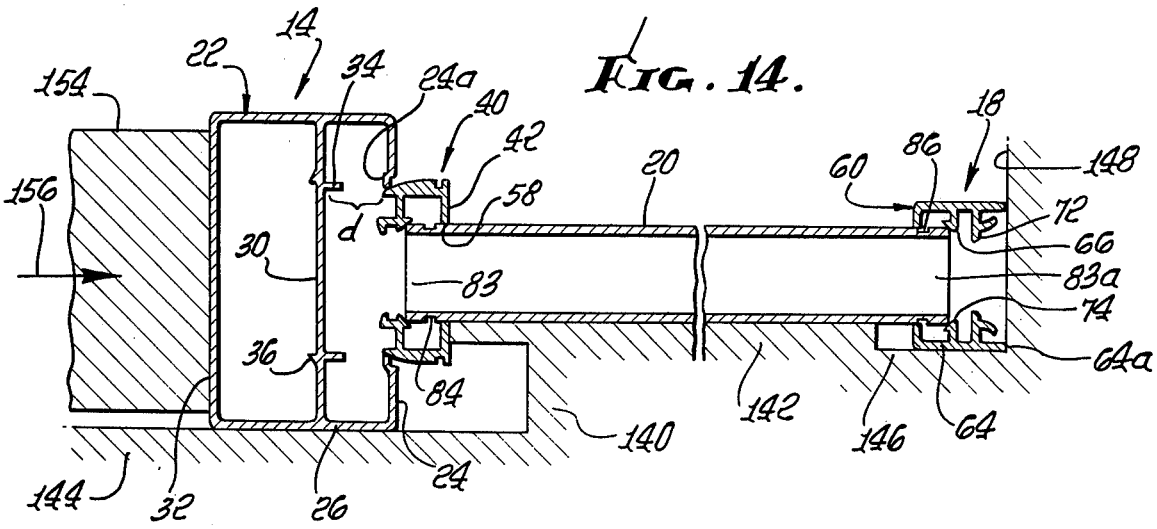
FIG. 14 is a section on the line and looking in the direction of the arrows 14—14.
Figure 16:
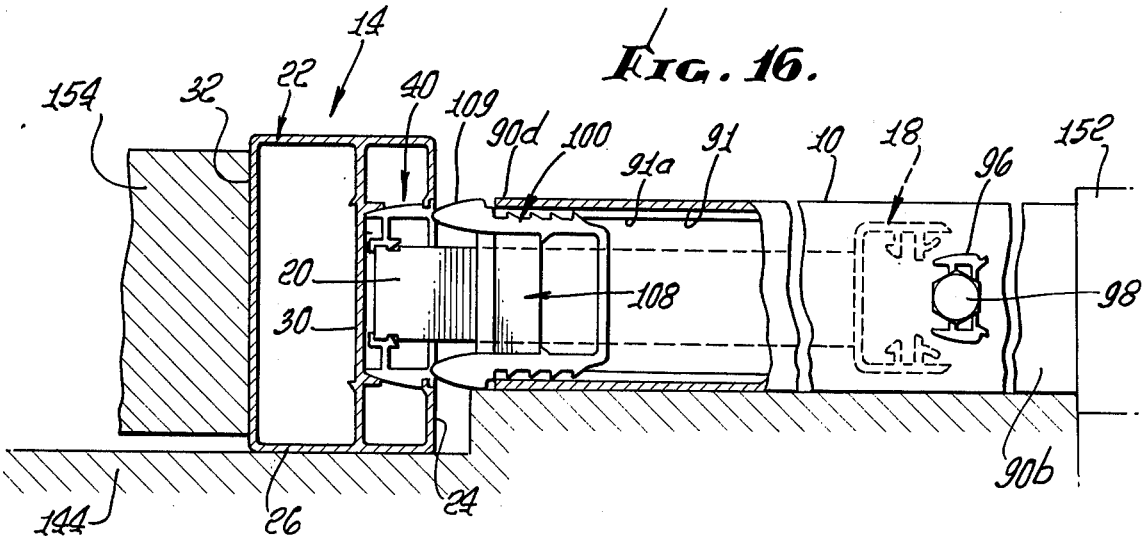
FIG. 16 is a section on the line and looking in the direction of the arrows 16—16 in FIG. 15.
Figure 15:
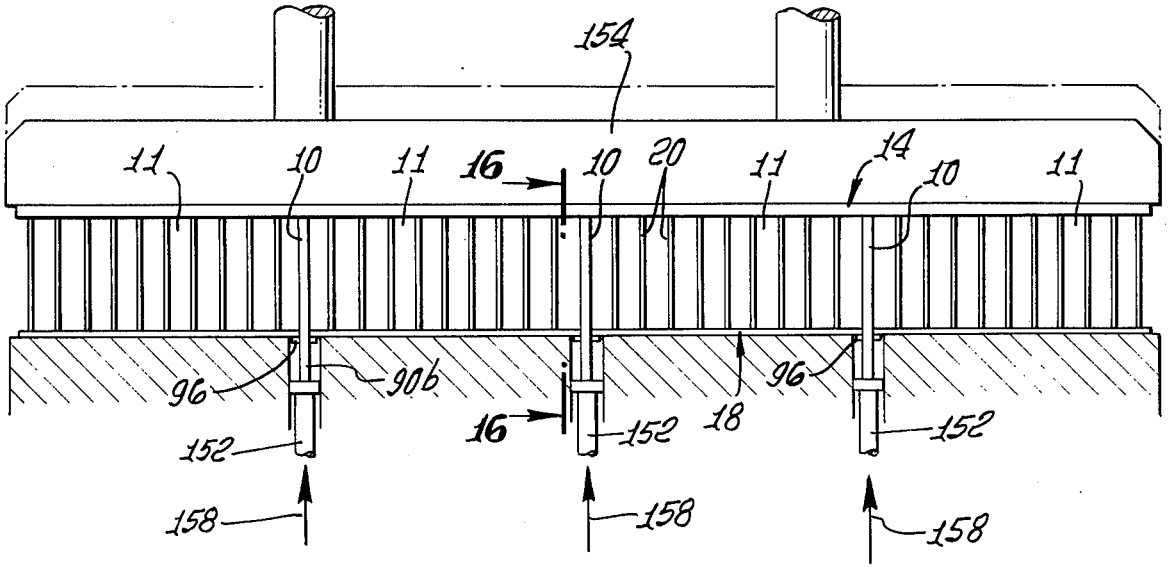
FIG. 15 is a view similar to FIG. 13 but showing the top railing assembly in assembled condition with the posts ready for insertion.

The lower level section 144, on which the channel element 22 will be laid on its side as shown in FIGS. 14 and 16, should be at such a level as to properly align the opening, defined by the edges 24*a* of the folded-over portions 24 of the sidewalls 26 of the channel member 22, with the bottom cover locking plate 40 after it has been mounted on the ends of the pickets 20 in the manner shown in FIG. 14. The lower level 146 on the opposite side of the raised table portion 142 desirably should be such as to enable each bottom rail channel element 60, when laid on one of its sides 64, to be properly aligned with each of the lower ends 83*a*, of the pickets 20 for insertion of such ends 83*a* into the element 60 in the manner hereinabove described and particularly illustrated in FIGS. 3 and 14 of the drawings.

In effecting the assembly of both the individual components of each railing section 11 as well as of several sections 11 with mounting posts 10 interposed between each adjoining pair of railing sections 11, the ends of the pickets 20 may be inserted into the orifices in the bottom locking cover plate 40 and in the bottom rail channel member 60 to where each end abuts the ramp 56, in the case of the orifice 58 in the bottom locking cover plate 40, or the projections 66, in the case of the bottom rail channel member 60. The bottom locking cover plates 40 and bottom rail channel members 60 are laid out on the table 140 in abutment with and separated by the mounting posts 10 which are to be included with a complete railing section of a predetermined length such as, for example, 20 feet. Each post 10 should have inserted in its upper end 90*d* its U-shaped capping member 100 and the wedge 108 driven down inside between the sidewalls 102 of the member 100 so that upper extremities 109 of the walls 102 are ready to be forced between the opposing edges 24*a* of the bent over portions 24 of the sidewalls 26 of the element 22. The bottom edges 64*a* of the sidewalls 64 of the bottom channel elements 60 are placed in abutment with a vertical wall 148. The posts 10, however, are not supported at their lowermost flared ends 90*b* but, simply, extend into culverts or channels 150 and are spaced from the heads of pistons or other pusher elements 152, the function of which will later be described.

With a top rail channel member 22 laid on one of its sides 26 on the lower level table deck 144 and extending the full length of the plurality of sections 11 thus laid together and with the posts 10 serving as spacers, a pusher wall or beam 154 is brought into abutment with the top transverse wall 32 of the element 22. Upon further moving in the direction of the arrow 156 for a distance equal to distance *d* in FIG. 14, the pusher beam 154 will shift the channel element 22 relative to the upper notched ends 83 of the pickets and the locking cover plates 40 into which such pickets ends 83 have been inserted, and will almost simultaneously snap-lock the upper notched ends 83 of the pickets between the channel members 50 by the projection 54 entering the picket notches 84, while causing the arcuate sidewalls 46*b* of the plates 40 to pass between the oppositely facing edges 24*a* of the bent over portions 24 of the sidewalls 26 of the top rail channel element 22. When such movement is completed, the joinder of the cover plate locking element 40 with the channel element 22 will be accomplished in the manner heretofore described under the heading "Interfitting of Assembly Components". In addition, at about the same instant the lower notched ends 83*a* of the pickets 20 are forced between the flanges 66 to where the angular edges 74 enter the notches 86 thereby locking such ends in the bottom channel members 60.

However, since the posts 10 are not held in position by the wall 148 or any other immovable object, interfitting of the posts 10 with both the top rail assembly 14 and the bottom rail assembly 18 is not accomplished at this time. Such interfitting may be effected after the pusher beam 154 has moved from the dotted line position shown in FIG. 15 to its solid line position in abutment with the top rail channel element 22 with which the cover locking plate 40 and the picket ends have now been securely interfitted. In this disposition of the thus far complete railing assembly, the pistons or pushers 152 are now advanced in the direction of the arrows 158 in FIG. 15 to where they first come into contact with the lower flared ends 90*b* of the post 10. As previously mentioned, these posts have already had manually inserted in their upper ends 90*d* their U-shaped locking caps 100, each with a wedge 108 also manually driven into the cap 100 to secure the latter in such upper post end. As the pushers or pistons 152 advance further in the direction of the arrows 158, the arcuate sidewalls of the upper extremities 109 of the capping element 100 will be forced between the sidewalls 26 of the top rail channel element 22 to lock the same in the channel member 22 in the manner illustrated in FIG. 4 and hereinabove discussed in connection with that figure. Simultaneously, however, the adapters 96 are forced into the bottom rail channel elements 60 to become locked therein, also as illustrated in FIG. 4 and heretofore discussed in connection with that figure. Thereupon, a complete long railing assembly section consisting, for example, of four railing sections 11 and three mounting posts 10 may be seen to have been permanently assembled for shipment to the construction site where the railing assembly is to be installed. Labor and materials costs for such railing assembly and installation will be found to be substantially less than has been required for prior art railing assemblies.

Figure 17:
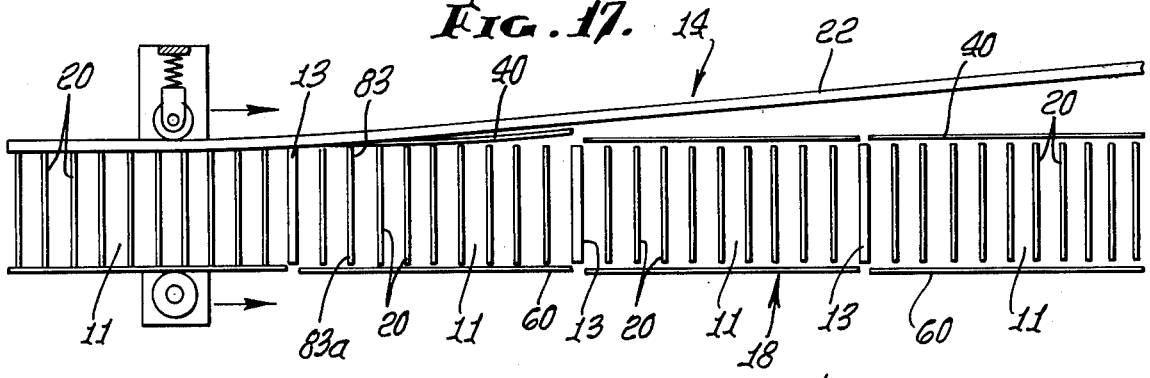
FIG. 17 is a schematic view of an alternate method of assembling the top and bottom rail assemblies with pickets.
Figure 18:
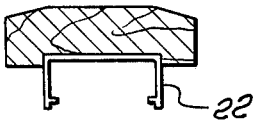
FIGS. 18 through 21 are cross sectional views of different types of top rail members which may be substituted for the channel member 22 in the embodiment of FIGS. 1 through 17.
Figure 20:
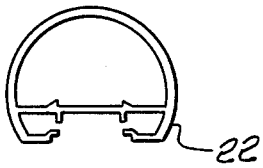
Figure 19:
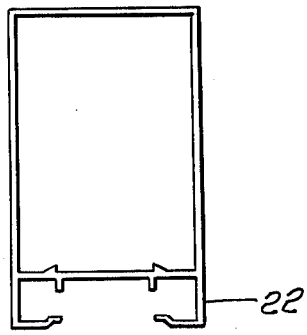
Figure 21:
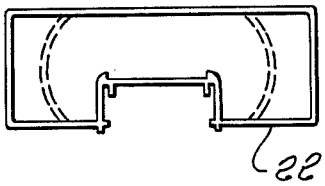

An alternative apparatus for and method of assembling long sections of railing assemblies 11 is illustrated in FIG. 17. In this method, a plurality of short railing sections 11, each consisting of pickets 20 with their ends 83, 83*a* inserted in a locking cover plate 40 and a bottom rail channel element 60, and separated by spacers 13 corresponding in width to the posts, are aligned with the plate 40 adjacent a top rail element 22. The interfitting of the plates 40 and channel element 22 are accomplished by a rolling motion relative to the element 22, the element 60, or both. After the element 22 has been secured into the bottom cover locking plate 40 with its inserted picket ends 83*a*, the spacers 13 are removed and capped posts 10 are brought into the voids created by the removal of the spacers 13. The posts 10 are then interfitted by pressure with both the element 22 and the bottom channel element 60 in the manner heretofore discussed.

While the present invention has been particularly illustrated and described in conjunction with embodiments involving railing systems, the principles of this invention, as will be appreciated by those skilled in the art, may be applied to erecting any kind of grid which includes spaced parallel members interconnected by a plurality of transverse elements. Thus, for example, one could erect wall studding by utilizing essentially the same basic interfitting elements as, for example: providing a floor stringer similar to a bottom rail assembly 18, a parallel beam for ceiling attachment corresponding to the top rail assembly 14, end posts similar to the posts 10 or 10*a*, the interstitial studding corresponding to the pickets 20. In this manner, wall studding could be prefabricated and shipped to a building site where an entire studding wall could be put up and installed in a matter of minutes thereby to greatly reduce building costs.

Thus, it may be seen that the present invention offers many advantages over prior art devices.

I claim:

1. A grid structure, said structure comprising a. a top rail assembly, said assembly including i. an inverted U-shaped channel member of a predetermined length and fabricated of a rigid but resilient material, said member having a top wall, a pair of sidewalls joined to and extending down from the top wall, the lower portion of each of said sidewalls being bent over at a right angle toward the other sidewall thereby to be spaced from the top wall by a first predetermined distance, with the edges of both said bent over portions being spaced from each other by a second predetermined distance edge, and a pair of downwardly extending rails integral with the top wall, spaced from each other by said second predetermined distance, said rails having altitudes less than said first predetermined distance and being disposed in vertical alignment with said sidewall edges; and ii. a U-shaped channel member constituting a locking cover plate of a predetermined extent, of a width slightly greater than said second predetermined distance, and comprising a bottom wall and a pair of sidewalls joined to and extending upwardly from said bottom wall for approximately said first predetermined distance, the outer sides of said sidewalls being slightly convexed to arch towards each other, and longitudinal recesses being provided along the lines of joinder of said bottom wall and said sidewalls, said recesses being located and configured to receive the inwardly extending edges of the bent over portions of the sidewalls of the inverted U-shaped channel member; and said sidewalls further having flanges inwardly extending towards each other, but spaced from each other by a third predetermined distance, each of said flanges being capped by an L-shaped receiving channel element with the open side facing the open side of the other corresponding L-shaped channel element; the said bottom wall being orificed at predetermined spaced locations, said orificing being of a polygonal configuration with two opposite sides of the polygon being parallel to each other and to the sidewalls of said U-shaped channel member, and said opposite sides being disposed in each instance in vertical alignment with the open sides of said L-shaped receiving channel elements;

b. a bottom rail, said bottom rail comprising an inverted U-shaped rigid channel element of the same predetermined length as said locking cover plate of the top rail assembly and having a top wall from the side edges of which extend downwardly a pair of sidewalls, said top wall being orificed to the same polygonal configuration as the orificing in the planar bottom wall of said locking cover plate and with the same spaced locations, said sidewalls each having a pair of flanges spaced from the top wall and from each other and extending towards the corresponding flange on the opposite sidewall, the flanges more proximate to said top wall having angular opposed projecting edges, the last said edges being spaced from each other by substantially the same distance as separates the said hooking projections in the open sides of said L-shaped receiving elements in said locking cover plate; and the flanges most remote from said planar top wall extending inwardly towards each other further than the other flanges, thereby to provide a pair of shelves inwardly of said angular opposed projecting edges of the other flanges; and said bottom rail being disposed parallel to said top rail assembly in rectangular alignment therewith and spaced therefrom by a predetermined distance;

c. a plurality of rigid elements, each of said elements having a polygonal cross section corresponding to the orificing in both said locking cover plate of the top rail assembly and said top wall of said bottom rail, and extending through both of said orificings to where, in the case of the bottom rail, the end of said element rests on the pair of shelves provided by said most remote flanges; and in the case of the top rail assembly the end of said element seats in said L-shaped receiving channel elements in said locking cover plate; and said locking cover plate being inserted, with the ends of said elements so disposed in said L-shaped receiving channel elements, between the spaced edges of the lower portions of the sidewalls of the inverted U-shaped channel member of the top rail assembly to where the upper edges of its sidewalls seat against its top wall and abut the opposing faces of said rails, and said spaced edges seat in said longitudinal recesses; each of said rigid elements being grooved slightly inwardly from each of its ends transversely along the sides which, in the case of the top rail assembly seat in said L-shaped channel receiving elements and, in the case of the bottom rail, seat on said shelves; and upon both such seatings, said hooking projections in said L-shaped channel receiving elements, and said opposed angular edges of the bottom rail, enter said grooves, thereby locking said rigid elements within the top rail assembly and within said bottom rail respectively to prevent withdrawal therefrom.

2. A grid structure, said structure comprising:

a. a top rail assembly, said assembly including i. an inverted U-shaped channel member of a predetermined length and fabricated of a rigid but resilient material, said member having a planar transverse web, a pair of sidewalls extending down from the transverse web, the lower portion of each of said sidewalls being bent over at a right angle toward the other sidewall thereby to be spaced from the transverse web by a first predetermined distance, with the edges of both said bent over portions being spaced from each other by a second predetermined distance, and a pair of downwardly extending rails integral with the web and spaced from each other by said second predetermined distance, and said rails being disposed in vertical alignment with said sidewall edges; and ii. a U-shaped channel member to constitute a locking cover plate of a predetermined extent, of a width at least as great as said second predetermined distance, and comprising a bottom wall and a pair of sidewalls joined to and extending upwardly from said bottom wall for approximately said first predetermined distance, the outer sides of said sidewalls being slightly convexed to arch towards each other, the lines of joinder of said bottom wall and said sidewalls being configured to interlock with the inwardly extending edges of the bent over portions of the sidewalls of the inverted U-shaped channel member and said locking cover plate with said downwardly extending rails; and means cooperating with said channel member and cover plate to receive and secure against removal the end of a rigid vertical element when inserted in said orificing; other corresponding L-shaped channel element; the said bottom wall being orificed at predetermined spaced locations, said orificing being of a polygonal configuration with two opposite sides of the polygon being parallel to each other and to the sidewalls of said U-shaped channel member, and said opposite sides being disposed in each instance in vertical alignment with the open sides of said L-shaped receiving channel elements.

b. a bottom rail, said bottom rail comprising an inverted U-shaped channel element of the same predetermined length as said locking cover plate and having a top wall from the side edges of which extend downwardly a pair of sidewalls, said top wall being orificed to the same polygonal configuraand dimensions as the orificing in the bottom wall of said locking cover plate and with the same spaced locations, said sidewalls having means to receive and secure against removal the end of a rigid element inserted in the orificing in said top wall and said bottom rail being disposed parallel to said top rail assembly in rectangular alignment therewith and spaced therefrom by a fourth predetermined distance;

c. a plurality of rigid elements, each of said elements having i. a polygonal cross section of a configuration corresponding to the orificing in both said locking cover plate of the top rail assembly and said top wall of said bottom rail, ii. including means at each of its ends to cooperate with the means in said top rail assembly and said bottom rail for receiving and securing a rigid element, iii. having a length to extend between both said top rail assembly and said bottom rail with the ends of said rail element inserted through the correspondingly disposed orificing in the cover plate of the top rail assembly and in the bottom rail.

3. A grid structure, said structure comprising:

a. a top rail assembly, said assembly including i. an inverted U-shaped channel member of a predetermined length and fabricated of a rigid but resilient material, said member having a planar transverse web, a pair of sidewalls extending down from the transverse web, the lower portion of each of said sidewalls being bent over at a right angle toward the other sidewall thereby to be spaced from the transverse web by a first predetermined distance, said edges being spaced from each other by a second predetermined distance, and a pair of downwardly extending rails integral with the web and spaced from each other by said second predetermined distance, and said rails having altitudes less than said first predetermined distance and being disposed in vertical alignment with said sidewall edges; and ii. a U-shaped channel member to constitute a locking cover plate of a predetermined extent, of a width at least as great as said second predetermined distance, and comprising a bottom wall and a pair of sidewalls joined to and extending upwardly from said bottom wall for approximately said first predetermined distance, the outer sides of said sidewalls being slightly convexed to arch towards each other, the lines of joinder of said bottom wall and said sidewalls being configured to interlock with the inwardly extending edges of the bent over portions of the sidewalls of the inverted U-shaped channel member; and said sidewalls further having flanges extending inwardly towards each other, but spaced from each other by a third predetermined distance, each of said flanges being capped by an L-shaped receiving channel element with the open side facing the open side of the corresponding channel element on the opposite flange and each of said open sides being provided with a hooking projection directed toward said other corresponding L-shaped channel element; the said bottom wall being orificed at predetermined spaced locations, said orificing being of a polygonal configuration with two opposite sides of the polygon being parallel to each other and to the sidewalls of said U-shaped channel member, being spaced from each other by said third predetermined distance, and said opposite sides being disposed in each instance in vertical alignment with the open sides of said L-shaped receiving channel elements;

b. a bottom rail, said bottom rail comprising an inverted U-shaped rigid channel element of the same predetermined length as said locking cover plate of the top rail assembly and having a top wall from the side edges of which extend downwardly a pair of sidewalls, said top wall being orificed to the same polygonal configuration and dimensions as the orificing in the bottom wall of said locking cover plate and with the same spaced locations, said sidewalls each having a pair of inwardly extending flanges one below the other and spaced from the top wall and from each other, each of said pair of flanges extending towards the corresponding flange on the opposite sidewall, the two flanges more proximate to said top wall having angular projecting edges, the last said edges being spaced from each other by substantially the same distance as separates the said hooking projections in the open sides of said L-shaped receiving elements in said locking cover plate; and the pair of flanges most remote from said top wall extending inwardly towards each other further than the other flanges, thereby to provide a pair of shelves inwardly of said angular opposed projecting edges of the other flanges; and said bottom rail being disposed parallel to said top rail assembly in rectangular alignment therewith and spaced therefrom by a fourth predetermined distance;

c. a plurality of rigid elements, each of said elements
   i. having a polygonal cross section of a configuration corresponding to the orificing in both said locking cover plate of the top rail assembly and said top wall of said bottom rail,
   ii. being grooved slightly inwardly from each of its ends transversely along its opposite parallel sides, and
   iii. having a length to extend between both said top rail assembly and said bottom rail with the end of said rigid element inserted through the correspondingly disposed orificing in the cover plate of the top rail assembly and in the bottom rail to where, in the case of the bottom rail, the end of said element rests on the pair of shelves provided by said most remote flanges and said opposed angular edges of the bottom rail enter the grooves in the end of said rigid element and thereby lock said rigid element within said bottom rail to prevent withdrawal therefrom; and in the case of the top rail assembly the end of said rigid element seats within said L-shaped receiving channel elements in said locking cover plate and said hooking projections enter the grooves in the end of said rigid element; and said locking cover plate, with the plurality of said rigid elements so disposed in said L-shaped receiving channel elements, being inserted between the spaced edges of the lower portions of the sidewalls of the inverted U-shaped channel member of the top rail assembly to where the upper edges of its sidewalls seat against said web and abut the opposing faces of said web rails and said spaced edges interlock with the configured lines of joinder of the bottom wall and sidewalls of said locking cover plate.

4. A railing section comprising:

a. a top rail assembly, said assembly including
   i. an inverted U-shaped channel member of a predetermined length and fabricated of a rigid but resilient material, said member having a planar transverse web, a pair of sidewalls extending down from the transverse web, the lower portion of each of said sidewalls being bent over at a right angle toward the other sidewall thereby to be spaced from the transverse web by a first predetermined distance with the edges of both said bent over portions being spaced from each other by a second predetermined distance, and a pair of downwardly extending rails integral with the web and spaced from each other by said second predetermined distance, and said rails being disposed in vertical alignment with said sidewall edges; and
   ii. a U-shaped channel member to constitute a locking cover plate of a predetermined extent of a width at least as great as said second predetermined distance, and comprising a bottom wall and a pair of sidewalls joined to and extending upwardly from said bottom wall for approximately said first predetermined distance, the outer sides of said sidewalls being slightly convexed to arch towards each other, the lines of joinder of said bottom wall and said sidewalls being configured to interlock with the inwardly extending edges of the bent over portions of the sidewalls of the inverted U-shaped channel member; the said bottom wall being orificed at predetermined spaced locations, said orificing being of a square configuration with two opposite sides of the square being parallel to the sidewalls of said U-shaped channel member, being spaced from each other by a third predetermined distance, and said opposite sides being disposed in each instance in vertical alignment with said downwardly extending rails; and said locking cover plate having internal means cooperating with said inverted U-shaped channel member to receive and secure against removal the end of a rigid vertical element when such an element is inserted in said orificing;

b. a bottom rail, said bottom rail comprising an inverted U-shaped rigid channel element of the same predetermined extent as said locking cover plate and having a top wall, sidewalls extending downwardly from the edges of said top wall, said top wall being orificed to the same configuration and dimensions as the orificing in the bottom wall of said locking cover plate and with the same spaced locations, said sidewalls having between them means to receive and secure against removal the end of a rigid element inserted in the orificing in said top wall, and said bottom rail being disposed parallel to said top rail assembly in rectangular alignment therewith and spaced therefrom by a fourth predetermined distance;

c. a plurality of rigid elements, each of said elements
   i. having a square cross section of dimensions corresponding to the orificing in both said locking cover plate of the top rail assembly and said top wall of said bottom rail,
   ii. including means at each of its ends to cooperate with the means for receiving and securing a rigid element in each of said locking cover plate and bottom rail, and
   iii. having a length to extend between both said top rail assembly and said bottom rail with the ends of said rigid element inserted through the correspondingly disposed orificing in the cover plate of the top rail assembly and in the bottom rail to where the ends of said element are received and secured by the means therefore in both the top rail assembly and the bottom rail.

5. A railing section comprising:

a. a top rail assembly, said assembly including
i. an inverted U-shaped channel member of a predetermined length and fabricated of a rigid but resilient material, said member having a top wall, a planar transverse web spaced from the top wall and extending between the sidewalls intermediate the side edges thereof, said web being internally formed with said sidewalls, the lower side of each of said sidewalls having a portion which is bent over at a right angle toward the other sidewall thereby to be spaced from the transverse web by a first predetermined distance, the edges of said bent over portion being spaced from each other by a spaced predetermined distance, and a pair of downwardly extending rails integral with the web and spaced from each other by said second predetermined distance, and said rails being disposed in vertical alignment with said sidewall edges; and
ii. a U-shaped channel member to constitute a locking cover plate of a predetermined extent, of a width at least as great as said second predetermined distance, and comprising a bottom wall and a pair of sidewalls joined to and extending upwardly from said bottom wall for approximately said first predetermined distance, the outer sides of the last said sidewalls being slightly convexed to arch towards each other, the lines of joinder of said bottom wall and said sidewalls being configured to interlock with the inwardly extending edges of the bent over portions of the sidewalls of the inverted U-shaped channel member; the said bottom wall being orificed at predetermined spaced locations, said orificing being of a square configuration with top opposite sides of the square being parallel to the sidewalls of said U-shaped channel member, being spaced from each other by said second predetermined distance and said opposite sides being disposed in each instance in vertical alignment with said downwardly extending rails, and said locking cover plate having internal means cooperating with said channel member to receive and secure against removal the end of a rigid vertical element when inserted in said orificing;
b. a bottom rail, said bottom rail comprising an inverted U-shaped rigid channel element of the same predetermined extent as the locking cover plate of said top rail assembly and having a top wall, sidewalls extending downwardly from the edges of said top wall, said top wall being orificed to the same configuration and dimensions as the orificing in the bottom wall of said locking cover plate and with the same spaced locations, said sidewalls having means between them to receive and secure against removal the end of a rigid element inserted in the orificing in said top wall and said bottom rail, being disposed parallel to said top rail assembly in rectangular alignment therewith and spaced therefrom by a third predetermined distance;
c. a plurality of rigid elements, each of said elements
i. having a square cross section of dimensions corresponding to the orificing in both said locking cover plate of the top rail assembly and said top wall of said bottom rail,
ii. including means at each of its ends to cooperate with the means for receiving and securing a rigid element in each of said locking cover plate and said bottom rail, and
iii. having a length to extend between both said top rail assembly and said bottom rail with the ends of said rigid element inserted through the correspondingly disposed orificing in the cover plate of the top rail assembly and in the bottom rail to where the ends of said element are received and secured by the means therefore in both the top rail assembly and the bottom rail.

6. A railing section comprising:
a. a top rail assembly, said assembly including
i. an inverted U-shaped channel member of a predetermined length and fabricated of a rigid but resilient material, said member having a top wall, a pair of sidewalls joined to and extending down from the top wall, a planar transverse web spaced from the top wall and extending between the sidewalls intermediate the side edges thereof, said web being internally formed with said sidewalls, the lower side of each of said sidewalls having a portion which is bent over at a right angle toward the other sidewall thereby to be spaced from the transverse web by a first predetermined distance, the edges of said bent over portion being spaced from each other by said second predetermined distance, and said rails being disposed in vertical alignment with said sidewall edges; and
ii. a U-shaped channel member to constitute a locking cover plate of a predetermined extent, of a width at least as great as said second predetermined distance, and comprising a bottom wall and a pair of sidewalls joined to and extending upwardly from said bottom wall for approximately said first predetermined distance, the outer sides of the last said sidewalls being slightly convexed to arch towards each other, the lines of joinder of said bottom wall and said sidewalls being configured to interlock with the inwardly extending edges of the bent over portions of the sidewalls of the inverted U-shaped channel member; the said bottom wall being orificed at predetermined spaced locations, said orificing being of a square configuration with two opposite sides of the square being parallel to the sidewalls of said U-shaped channel member, being spaced from each other by said second predetermined distance and said opposite sides being disposed in each instance in vertical alignment with said downwardly extending rails; and said locking cover plate having internal means cooperating with said channel member to receive and secure against remove the end of a rigid vertical element when inserted in said orificing;
b. a bottom rail, said bottom rail comprising an inverted U-shaped rigid channel element of the same predetermined extent as the locking cover plate of said top rail assembly and having a top wall, sidewalls extending downwardly from the edges of said top wall, said top wall being orificed to the same configuration and dimensions as the orificing in the bottom wall of said locking cover plate and with the same spaced locations, said sidewalls having means between them to receive and secure against removal the end of a rigid element inserted in the orificing in said top wall and said bottom rail, being disposed parallel to said top rail assembly in rectangular alignment therewith and spaced therefrom by a third predetermined distance;

c. a plurality of rigid elements, each of said elements
   i. having a square cross section of dimension corresponding to the orificing in both said locking cover plate of the top rail assembly and said top wall of said bottom rail,
   ii. including means at each of its ends to cooperate with the means for receiving and securing a rigid element in each of said locking cover plate and said bottom rail, and
   iii. having a length to extend between both said top rail assembly and said bottom rail with the ends of said rigid element inserted through the correspondingly disposed orificing in the cover plate of the top rail assembly and in the bottom rail to where the ends of said element are received and secured by the means therefore in both the top rail assembly and the bottom rail, and d. at least one mounting support post for interconnection with both said top rail assembly and said bottom rail, said post being hollow and rectangular in cross section, and of a length to extend between said top rail assembly and a point located a predetermined distance below said bottom rail on a line parallel to a line through a sidewall of any of the said pickets, the bottom of said post being securable in a hole in decking on which the railing section is to be erected, said post having inserted in its upper end a U-shaped mounting cap having a bottom wall and a pair of sidewalls and being secured in the top of said post by a wedge forced in between said sidewalls, said sidewalls having convexed upper portions protruding above the top of said post after said cap has been secured therein, each of said convexed portions having a locking groove at its base above the top edge of the post, and said convexed upper portion of said sidewalls being inserted up into in said inverted U-shaped channel element at a location not covered by said locking cover plate, and between the edges of said bent over portions of the sidewalls of the last said channel element to where the last said edges seat in said locking grooves; and said post having at least one mounting element laterally projecting from a side thereof, parallel to said rail assembly and spaced from the locking grooves by said third predetermined distance, said mounting element comprising a U-shaped channel element having convex sidewalls with locking grooves along the lower edges thereof, the convex sidewalls of said mounting element being inserted up into said bottom rail, said bottom rail including downwardly extending flange means which, upon such insertion of said convex sidewalls of said mounting element snap into the last said locking grooves, thereby to secure and support said bottom rail on said post.

7. The railing section as defined in claim 6 wherein the predetermined extent of both the locking cover plate and the bottom rail is of such lesser length than that of the inverted U-shaped channel member of the top rail assembly as to permit the locking cap of a post to be inserted in said channel member at each end of said locking cover plate and a mounting element on each said post, to be inserted into the underside of the bottom rail at each end thereof, whereby the railing section may be supported on the decking by at least two said posts.

8. The railing section as defined in claim 6 wherein a plurality of mounting support posts as provided at regularly spaced intervals, said posts are spanned by and have mounted thereon the elongated inverted U-shaped channel member of the top rail assembly, and between each adjacent pair of posts extend a locking cover plate and a bottom rail, the latter being secured to mounting elements extending laterally from said adjacent posts, and a plurality of pickets spaced from each other are interfitted and secured to both said top rail and said bottom rail.

9. The railing section as defined in claim 3 wherein the underside of the bottom rail is closed by a U-shaped cover plate inserted from below and cooperating means are provided in said bottom rail and cover plate to lock said cover plate into said bottom rail channel member and to prevent removal of said plate therefrom.

10. An interlocking assembly, said assembly comprising a. an inverted U-shaped channel member of a predetermined length and fabricated of a rigid but resilient material, said member having a planar top wall, a pair of sidewalls joined to and extending down from the top wall, the lower portion of each of said sidewalls being bent over at a right angle toward the other sidewalls thereby to be spaced from the top wall by a first predetermined distance, with the edges of both said bent over portions being spaced from each other by a second predetermined distance edge, and a pair of downwardly extending rails integral with the top wall, spaced from each other by said second predetermined distance, said rails having altitudes less than said first predetermined distance and being disposed in vertical alignment with said sidewall edges;

b. a U-shaped channel member constituting a locking cover plate of a width slightly greater than said second predetermined distance, and comprising a bottom wall and a pair of sidewalls joined to and extending upwardly from said bottom wall for approximately said first predetermined distance, the outer sides of said sidewalls being slightly convexed towards each other, and longitudinal recesses being provided along the lines of joinder of said bottom wall and said sidewalls, said recesses being located and configured to receive the inwardly extending edges of the bent over portions of the sidewalls of the inverted U-shaped channel member; and said sidewalls further having flanges inwardly extending towards each other, but spaced from each other by a third predetermined distance, each of said flanges being capped by an inverted L-shaped receiving channel element with the open side facing the open side of the other corresponding channel element, and each of said open sides including a hooking projection directed toward said other corresponding L-shaped channel element; the said bottom wall having at least one orifice, said orifice being of a polygonal configuration with two opposite sides of the polygon being parallel to each other and sidewalls of said U-shaped channel member, and said opposite sides being disposed in each instance in vertical alignment with the open sides of said inverted L-shaped receiving channel elements;

c. a rigid vertical element for each said orifice, each of said vertical elements having a polygonal cross section corresponding to the orifice in said locking cover plate and extending through said orifice to where the upper end of said vertical element seats in said L-shaped receiving channel elements in said locking cover plate, and said locking cover plate being inserted with said element end so disposed in said L-shaped receiving channel elements between the spaced edges of the lower portions of the sidewalls of the inverted U-shaped channel member to where the upper edges of the sidewalls of the last said channel member seat against said top wall and abut the opposing faces of said downwardly projecting rails, and said spaced edges seat in the said longitudinal recesses; the upper end of each of said vertical elements being grooved slightly inwardly from its said end transversely along the sides which seat in between said L-shaped channel receiving elements, and said hooking projections in said L-shaped channel receiving elements enter said grooves, thereby locking each said rigid element within the locking cover plate to prevent withdrawal therefrom, and said locking cover plate is securely supported and locked within said inverted U-shaped channel member.

11. An interlocking assembly, said assembly comprising:

a. an inverted U-shaped rigid channel element, said element having a top wall from the side edges of which extend downwardly a pair of sidewalls, at least one orifice in said top wall, said orifice being of polygonal configuration with two opposite sides of the polygon being parallel to each other and to the sidewalls of said channel element, said sidewalls each having a pair of flanges spaced from the top wall and from each other and extending towards the corresponding flange on the opposite sidewall, the flanges more proximate to said top wall having angular opposed projecting edges, the last said edges being spaced from each other by a slightly less distance than the distance which separates the opposite parallel sides of each said at least one orifice in said top wall, and the flanges most remote from said top wall extending inwardly towards each other further than the other flanges, thereby to provide a pair of shelves inwardly of said angular opposed projecting edges of the other flanges;

b. a rigid vertical element for each said orifice, each of said elements having a polygonal cross section corresponding to the orifice in said top wall of said channel element, and extending through said orifice to where the end of said element rests on said pair of shelves provided by said most remote flanges; each of said elements being grooved slightly inwardly from its lower end transversely along the sides which seat on said shelves and said opposed angular projecting edges of the flanges more proximate to the top wall enter said grooves and thereby lock each said rigid vertical element within said channel element to prevent withdrawal therefrom, and said vertical rigid element is securely supported in the latter channel element.

12. The assembly as described in claim 11 wherein each of the flanges most remote from said top wall further includes a wall projecting downwardly and outwardly toward its sidewall to define a slot, and a U-shaped closure plate is provided with upwardly extending sidewalls each of which seats in one of said slots.

13. In a railing assembly structure comprising a top rail, a bottom rail and a series of pickets spaced from each other and secured to both the top rail and the bottom rail wherein the bottom rail comprises a. an inverted U-shaped rigid channel element of a predetermined extent, with the last said channel element having a top wall and sidewalls extending downwardly from the edges of said top wall, said top wall being orificed to receive and securely hold the pickets, b. said sidewalls each having a pair of flanges spaced from the top wall and each other and extending towards the corresponding flange on the opposite sidewall, the flanges more proximate to said top wall having angular opposed projecting edges, the last said edges being spaced from each other by substantially the width of each picket; and the flanges most remote from said top wall also extending inwardly towards each other and terminating in angular edges;

c. a mounting element for one end of said bottom rail, said element projecting horizontally from a vertical surface on which said bottom rail is to be supported, said mounting element being disposed at an altitude conciding with the altitude at which said bottom rail is to be disposed in said rail structure, said mounting element comprising a U-shaped channel element having convex sidewalls arching towards each other, locking grooves along the lower edges thereof, the convex sidewalls of said mounting element being inserted up in between the inwardly extending flanges of the sidewall of the U-shaped channel element of said bottom rail to where the angular edges of said flanges most remote from the top wall of the last said element snap into said locking grooves and the other angular edges of the flanges most proximate to said top wall press against the convex sidewalls of said U-shaped channel element, thereby to secure and support said bottom rail on said vertical surface.

14. A mounting post top rail interlock arrangement for permanently mounting and securing a top railing assembly of a railing section including such top rail assembly, at least one bottom rail and a series of vertical pickets spaced from each other and extending vertically between said top rail assembly and said bottom rail, upon a vertical mounting post embedded solidly in decking or other horizontal surface, said top railing assembly including a. an inverted U-shaped channel member of a predetermined length and fabricated of a rigid but resilient material, said member having a top wall, a pair of sidewalls joined to and extending down from the top wall, the lower portion of each of said sidewalls being bent over at a right angle toward the other sidewall thereby to be spaced from the top wall by a first predetermined distance, the edges of said bent over portions being spaced from each other by a second predetermined distance, and a pair of downwardly extending rails integral with the top wall and spaced from each other by said second predetermined distance, and said rails being disposed in vertical alignment with said sidewall edges; and b. said mounting post being hollow and rectangular in cross section, open at its upper end and of a length to extend between said top rail assembly and a point located a predetermined distance below said bottom rail on a line parallel to a line through a sidewall of any of the said pickets, the bottom of said post being securable in a hole in decking on which the railing section is to be erected, c. a U-shaped mounting cap, said cap being inserted in the open upper end of said post, and said cap having a bottom wall and a pair of sidewalls yieldably forced therewith, a wedging element, said wedging element being of such dimension as to be adapted to be force fitted between the sidewalls of said cap to press them apart into tight contact with the insides of the upper end of the post, said cap sidewalls having convexed upper portions slightly arched towards each other protruding above the top of said post after said cap has been wedged therein, each of said convexed portions having a locking groove at its base above the top edge of the post, and said convexed upper portion of said sidewalls being inserted up in between said edges of the bent over portions of the sidewalls of said inverted U-shaped channel element to where the leading edges of the upper convexed portion of the sidewalls of the U-shaped mounting cap abut the top wall of the inverted U-shaped channel element and the opposing faces of the rails protruding downwardly from said top wall, and the edges of the bent over portions of the sidewalls of the inverted U-shaped channel element seat in said locking grooves.

15. The interlock arrangement as described in claim 14 wherein the wedging element comprises a polygonal plate having a pair of opposite parallel sides and a pair of parallel rails spaced from each other and extending downwardly from said plate, said plate being placed between the sidewalls of the mounting cap with the last said rails spanning said mounting cap sidewalls, and said rails and cap being forceably driven down between said sidewalls.

16. The interlock arrangement as described in claim 15 wherein inwardly extending flanges are provided to extend from the insides of the mounting cap sidewalls, said flanges being disposed at a level to properly limit the extent to which the wedging element can be driven down between the mounting cap sidewalls so that the convexed portions thereof and their locking grooves protrude above the top edges of the post.

17. Means to effect a joinder at a right angle of a pair of 45° angle mitered rails and to mount them on top of the open end of a hollow mounting post of a square cross-sectional configuration, each of said rails comprising an inverted U-shaped channel member, said member having a top wall, a pair of sidewalls joined to and extending down from said top wall, a planar transverse web spaced from said top wall by a first predetermined distance and extending between the sidewalls intermediate the upper and lower edges thereof, said web being integrally formed with said sidewalls, and said web being orificed at a predetermined location adjacent its mitered edge, the lower portion of each said sidewall being bent over at a right angle toward the other sidewall thereby to be spaced from said transverse web by a first predetermined distance, the edges of said bent over portions being spaced from each other by a second predetermined distance, and a pair of downwardly extending rails integral with said web and also spaced from each other by said second predetermined distance, and said rails being disposed in vertical alignment with said sidewall edges and said web further having integrally formed therewith a pair of upwardly extending flanges disposed similarly to but directed oppositely from said pair of rails; said means comprising a. a double winged bracket, said bracket being of a height substantially less than said first predetermined distance and comprising a short central wall, said central wall being bifurcated at each end to form inner and outer wing extensions diverging from each other symmetrically with respect to said central wall at a 90° angle, the inner wing extension being adapted to abut the inwardly facing sides of the innermost upwardly directed abutting flanges of the two webs when their respective inverted U-shaped channel members are brought together at their mitered ends, the ends of the outer wing extension abutting the inwardly facing sides of the outermost upwardly directed abutting flanges of said webs, and each of said outer wing extensions having outer arcuate portions defining an open sided bolt receiving notch, each said notch, when said bracket is disposed on said abutting mitered webs, coinciding with the orifice in one of the two thus-brought-together mitered webs;

b. a post engaging element for disposition and bolting below each thus-brought-together mitered web, the last said element comprising a vertical wall extending diagonally between the insides of adjacent post sides, and a pair of oppositely directed arcuate walls, each extending from a point intermediate the side edges of said vertical wall around the projection of one of said web orifices and outwardly to the inside of one of the other two adjacent post sides; and c. a pair of bolts and nuts therefor, each of said bolts being passed between said vertical wall and one of said arcuate walls, through one of said web orifices and into one of said notches in the double winged bracket to protrude thereabove, and one of said nuts being threaded onto one of said protruding bolt ends, and said bolt and nut being tightened to hold together securely said bracket, web and post engaging element, thereby joining tightly said two mitered inverted U-shaped channel elements ends, so that when the post engaging element is forced down into the open end of the post, said thus joined mitered rail ends are securely supported by said post.

18. In a railing assembly, a. horizontally elongated and hollow top and bottom rails, b. a downwardly exposed, horizontally elongated insert plate structure received upwardly into and having detent locking connection to the top rail internally thereof, c. horizontally spaced, vertically elongated pickets having upper end portions which project into openings defined by the plate structure, and lower end portions which project into openings defined by the bottom rail, the plate structure and bottom rail having detent locking and vertically endwise seating connections to the picket upper and lower end portions, and d. vertical posts attached at their upper ends to the underside of the top rail, e. said insert plate structure extending endwise to terminate adjacent the tops of the posts.

* * * * *